US009625149B2

(12) United States Patent
Lyons et al.

(10) Patent No.: US 9,625,149 B2
(45) Date of Patent: Apr. 18, 2017

(54) THIN CHAMBER BURNER

(75) Inventors: David C. Lyons, Red Wing, MN (US); Travis P. Betcher, Goodhue, MN (US); Louis L. Mead, Lake City, MN (US)

(73) Assignee: HNI Technologies Inc., Muscatine, IA (US)

( * ) Notice: Subject to any disclaimer, the term of this patent is extended or adjusted under 35 U.S.C. 154(b) by 1009 days.

(21) Appl. No.: 13/396,363

(22) Filed: Feb. 14, 2012

(65) Prior Publication Data

US 2012/0199114 A1 Aug. 9, 2012

Related U.S. Application Data

(63) Continuation of application No. 13/257,239, filed as application No. PCT/US2010/025235 on Feb. 24, 2010, application No. 13/396,363, which is a continuation-in-part of application No. 12/405,842, filed on Mar. 17, 2009, now Pat. No. 8,147,240.

(51) Int. Cl.

| | |
|---|---|
| ***F24B 1/191*** | (2006.01) |
| ***F23D 14/84*** | (2006.01) |
| ***F23D 14/58*** | (2006.01) |
| ***F24C 3/08*** | (2006.01) |
| ***F24C 15/00*** | (2006.01) |

(52) U.S. Cl.

CPC ..... *F23D 14/84* (2013.01); *F23D 14/586* (2013.01); *F24C 3/082* (2013.01); *F24C 15/004* (2013.01); *F23D 2203/108* (2013.01); *F23D 2212/00* (2013.01); *F23D 2212/10* (2013.01); *F23D 2213/00* (2013.01); *F23D 2900/21004* (2013.01); *Y10T 29/49348* (2015.01); *Y10T 29/53* (2015.01)

(58) Field of Classification Search

CPC .. F23D 14/586; F23D 14/84; F23D 2203/108; F23D 2212/00; F23D 2212/10; F23D 2900/21004; F23D 2213/00; F24C 15/002; F24C 15/004; F24C 3/004; F24C 3/082; Y10T 29/53; Y10T 29/49348

USPC ..... 431/125, 350, 351, 354; 126/500, 512

See application file for complete search history.

(56) References Cited

U.S. PATENT DOCUMENTS

| | | | |
|---|---|---|---|
| 3,314,610 | A | 4/1967 | Reznor |
| 3,652,852 | A | 3/1972 | Miyazawa et al. |
| 3,831,582 | A | 8/1974 | Mahoney |
| 4,019,856 | A | 4/1977 | Lacroix |
| 4,149,447 | A | 4/1979 | Wiedermann |
| 4,637,372 | A | 1/1987 | Mogol et al. |

(Continued)

FOREIGN PATENT DOCUMENTS

| | | | |
|---|---|---|---|
| AU | 197611109 | A | 8/1977 |
| BE | 471362 | A | 2/1947 |
| DE | 2605954 | A1 | 8/1976 |
| EP | 0352342 | A1 | 1/1990 |
| GB | 1251153 | A | 10/1971 |

OTHER PUBLICATIONS

International Search Report and Written Opinion issued in PCT/US2010/025235, mailed Dec. 29, 2011, 11 pages.

*Primary Examiner* — Alfred Basichas

(74) *Attorney, Agent, or Firm* — Faegre Baker Daniels LLP

(57) ABSTRACT

Burner assemblies including panels (e.g., transparent panels) supported in a substantially parallel, closely-spaced relationship and gaskets and spacers sealing the space between the panels to form a perimeter seal and to define a plenum between the first and second panels with an inlet into the plenum and an outlet out of the plenum.

21 Claims, 19 Drawing Sheets

(56) References Cited

U.S. PATENT DOCUMENTS

| | | | | |
|---|---|---|---|---|
| 5,016,609 | A | 5/1991 | Shimek et al. | |
| 5,057,008 | A | 10/1991 | Dielissen | |
| 5,073,106 | A * | 12/1991 | Toyonaga et al. | 431/285 |
| 5,152,685 | A | 10/1992 | Coulon | |
| 5,479,916 | A | 1/1996 | Shimek et al. | |
| 5,645,409 | A | 7/1997 | Ni et al. | |
| 5,647,340 | A | 7/1997 | Shimek et al. | |
| 5,722,824 | A | 3/1998 | Beck | |
| 5,947,112 | A | 9/1999 | Hawkinson | |
| 6,036,474 | A | 3/2000 | Diep et al. | |
| 6,053,165 | A | 4/2000 | Butler et al. | |
| 6,095,794 | A | 8/2000 | Jamieson et al. | |
| 6,170,481 | B1 | 1/2001 | Lyons et al. | |
| 6,371,753 | B1 | 4/2002 | O'Donnel et al. | |
| 6,601,579 | B2 | 8/2003 | Fier et al. | |
| 6,916,174 | B2 | 7/2005 | O'Donnell et al. | |
| 7,077,122 | B2 | 7/2006 | Lyons et al. | |
| 7,101,174 | B2 | 9/2006 | Tomiura et al. | |
| 8,147,240 | B2 | 4/2012 | Lyons et al. | |
| 2003/0143507 | A1 | 7/2003 | Kuriyama et al. | |
| 2004/0248055 | A1 | 12/2004 | Mashhour | |
| 2005/0150485 | A1 * | 7/2005 | Barber | F24C 15/002 126/85 R |
| 2005/0227194 | A1 | 10/2005 | Weinberger | |
| 2006/0185664 | A1 | 8/2006 | Butler et al. | |
| 2009/0241936 | A1 | 10/2009 | Husted et al. | |
| 2010/0239990 | A1 | 9/2010 | Lyons et al. | |
| 2011/0053101 | A1 | 3/2011 | Gruenler et al. | |
| 2012/0024281 | A1 | 2/2012 | Lyons et al. | |

* cited by examiner

THIN CHAMBER BURNER

CROSS-REFERENCE TO RELATED APPLICATION

This application is a continuation of U.S. patent application Ser. No. 13/257,239, entitled "THIN CHAMBER BURNER", filed Sep. 16, 2011, which is a national phase application of PCT Application No. PCT/US2010/025235, filed pursuant to 35 U.S.C. §371. This application is also a continuation-in-part of U.S. patent application Ser. No. 12/405,842, entitled "THIN CHAMBER BURNER", filed Mar. 17, 2009. Priority is claimed to each of the foregoing applications, each of which is incorporated herein by reference in its entirety for all purposes.

BACKGROUND

Gas burners are used in gas fireplace units and other heating units to produce flames for visual effect and/or heating purposes. Typically, gas burners are used to combust a gas/air mixture thereby producing flames. Often times, gas burners are designed to produce flames that mimic an appearance of a natural, wood burning fire. More common gas burners include tube burners and pan burners. Although the tube- and pan-designs are common, other designs have become more common—including gas burners shaped to mimic an appearance of a wood log, for example.

SUMMARY

Some aspects described herein relate to a gas burner having a high degree of versatility in flame presentation, including, for example, the ability to hide various portions of the burner, produce various flame effects, and provide a slimmer burner design. The versatility of various embodiments described herein allows greater freedom in fireplace design and flame presentation.

For example, some aspects relate to a burner assembly adapted for combustion of gases associated with a heating unit, the burner assembly including two substantially transparent panels supported in a substantially parallel, closely-spaced relationship such that a viewer is able to see through the panels and gaskets and spacers sealing the space between the panels to form a perimeter seal and to define a plenum between the first and second panels with an inlet into the plenum and an outlet out of the plenum.

While multiple embodiments are disclosed, still other embodiments of the present invention will become apparent to those skilled in the art from the following detailed description, which shows and describes illustrative embodiments of the invention. Accordingly, the drawings and detailed description that follows are to be regarded as illustrative in nature and not restrictive.

Figure 1:
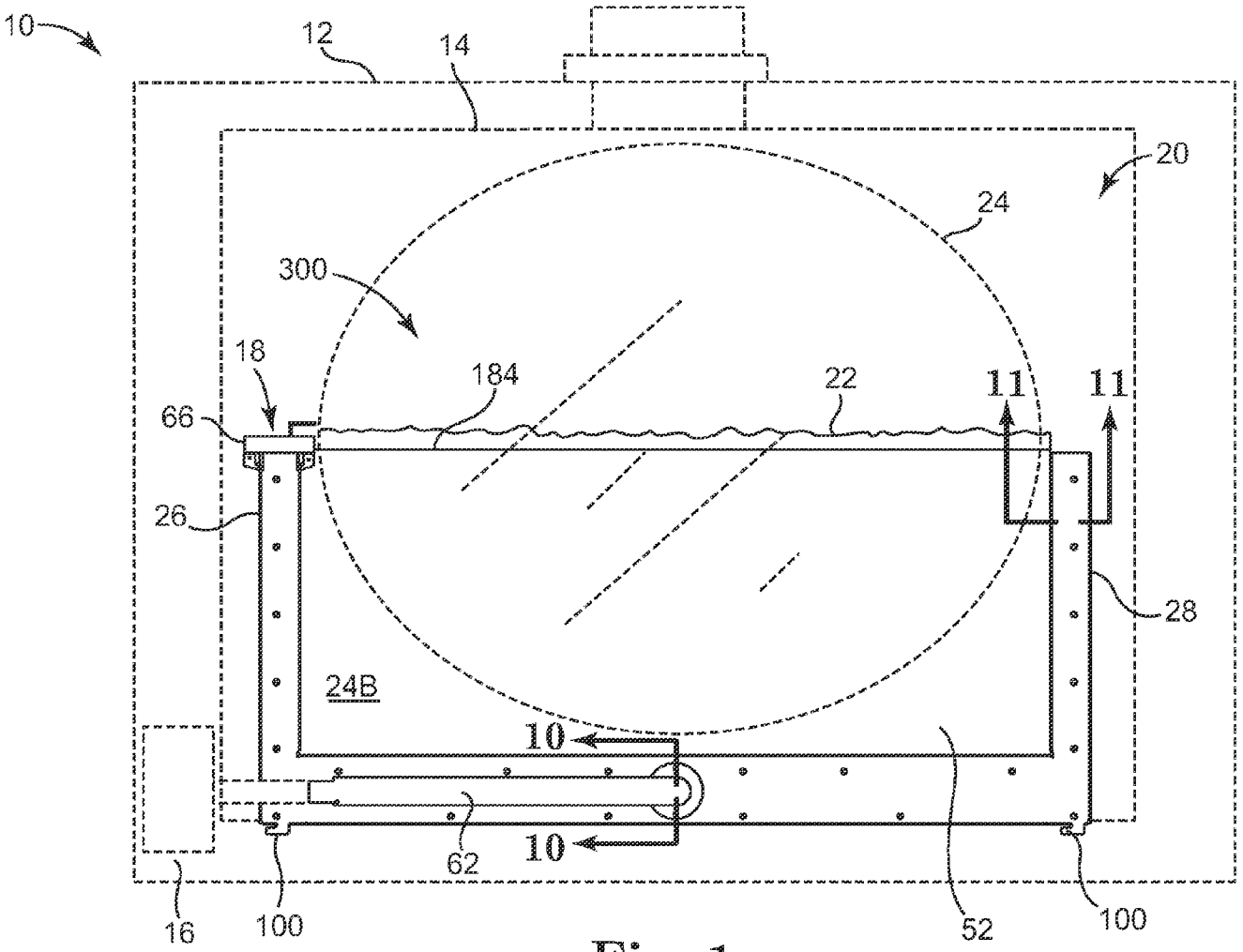
FIG. 1 is a front view of a fireplace including a burner assembly, according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to include all modifications, equivalents, and alternatives falling within the scope defined by the appended claims.

DETAILED DESCRIPTION

Some of the inventive aspects described herein relate to a gas burner having a high degree of versatility in flame presentation in a heating unit such as a fireplace or table top burner, including, for example, the ability to hide various portions of the burner assembly, produce various flame effects, and/or provide a slimmer burner assembly. The versatility of various embodiments described herein helps provide greater freedom in fireplace design and flame presentation. Although embodiments having the above-described features are provided herewith, additional or alternative features and associated advantages are also made apparent.

FIG. 1 is a front view of a fireplace 10, also described as a heating unit, including an outer housing 12, a combustion chamber 14, a gas source 16, and a burner assembly 18. For ease of illustration, the outer housing 12, combustion chamber 14, and gas source 16 are shown in broken lines.

The outer housing 12 is formed of any of a variety of suitable materials, including sheet metals, for example. Likewise, the combustion chamber 14 is formed of any of a variety of suitable materials, including molded ceramic fiber and binder composites, for example. The combustion chamber 14 defines a combustion enclosure 20 adapted to receive heat and combustion products from flames 22 produced by the burner assembly 18. The combustion chamber 14 includes a transparent front portion 24 (e.g., one or more sheets of transparent glass) for viewing into the combustion enclosure 20, as well as a transparent rear portion (not shown) as desired. In some embodiments, the combustion chamber 14 includes additional transparent portions (e.g., side, top, etc.) for viewing into the combustion enclosure 20.

The gas source 16 is optionally a regulator connected to an external gas line (not shown), such as a natural gas or LP gas line associated with residential, commercial, or other structure. Other gases are also contemplated, such as hydrogen, for example. In general terms, the burner assembly 18 of the fireplace 10 is adapted to direct flames into the combustion enclosure 20 of the combustion chamber 14.

Additional or alternative fireplace components associated materials, and configurations suitable for use in association with the burner assembly 18 are provided in various products offered by Hearth and Home Technologies, Inc. of Minnesota. As examples of patent literature, U.S. Pat. No. 5,016,609, entitled "Direct Vented Multi Glass Side Fireplace," U.S. Pat. No. 5,647,340, entitled "Convertible Dual Direct-Vented Fireplace," U.S. Pat. No. 5,947,112, entitled "Prefabricated Fireplace Exhaust Plenum Structure," U.S. Pat. No. 6,170,481, entitled "Open Ended Molded Fireplace Box and Method," and U.S. Pat. No. 7,077,122, entitled "Reduced Clearance Gas Fireplace," the entire contents of all of which are incorporated herein by reference, provide descriptions of additional or alternative fireplace components associated materials, and configurations suitable for use with the burner assembly 18, according to some embodiments.

As shown in FIG. 1, the burner assembly 18 has a first side 26 and a second side 28. In some embodiments, the burner assembly 18 is about 37 inches long, about 17 inches in height, and about 1.55 inches thick, although a variety of dimensions are contemplated. For reference, the terms "height" and "width" are used interchangeably with reference to the various embodiments described herein. Moreover, although various embodiments are described as being oriented "horizontally," "vertically," or "upright," flame generation using a horizontal orientation for burner assembly embodiments otherwise described as vertical and vice versa are contemplated.

Figure 2:
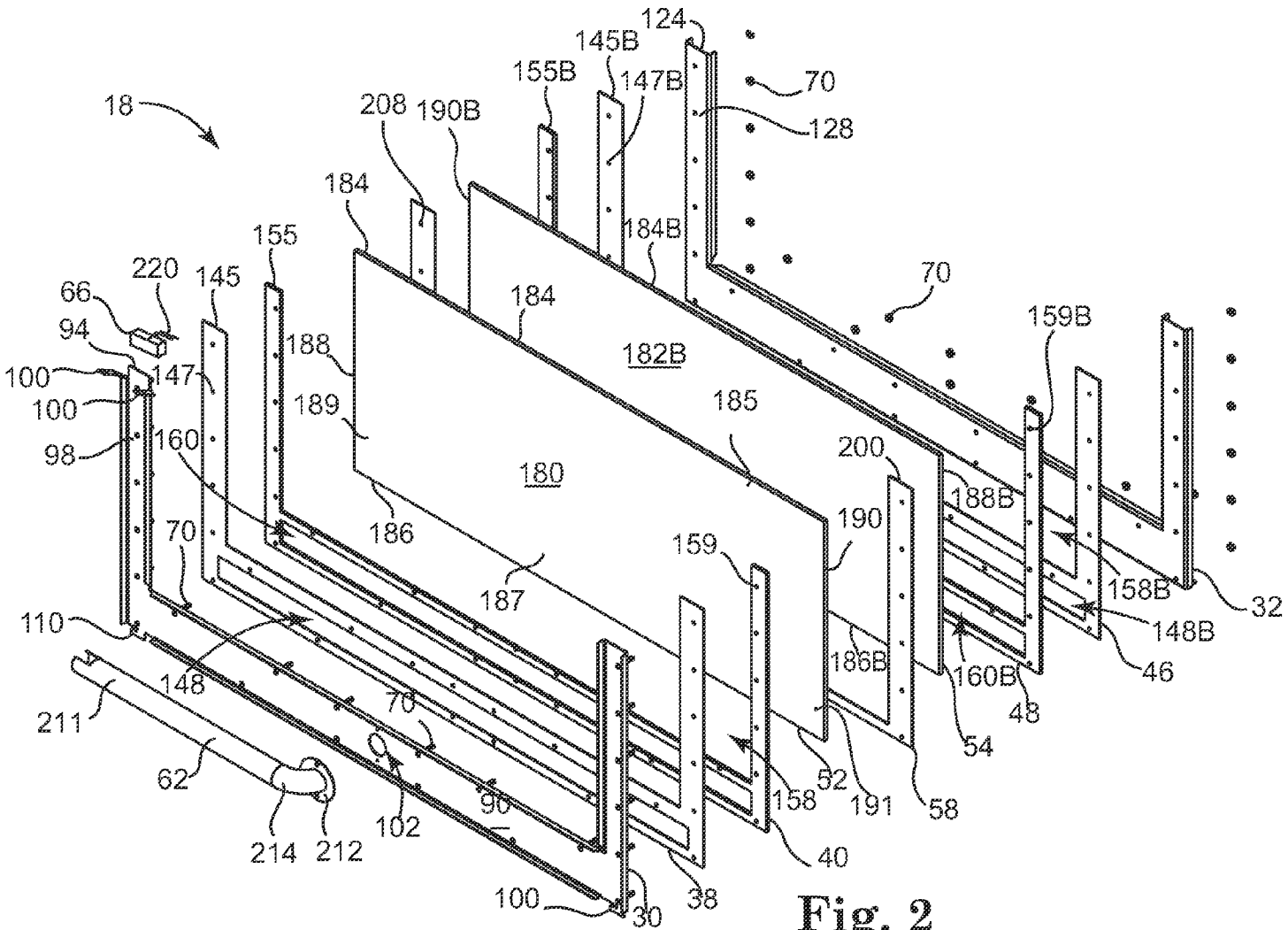
FIG. 2 is a perspective view of the burner assembly of FIG. 1 in an unassembled state, according to some embodiments.

FIG. 2 shows the burner assembly 18 in an unassembled state, according to some embodiments. As shown in FIG. 2, the burner assembly 18 includes a first frame member 30, a second frame member 32, a first intermediate seal 38, a first spacer 40, a second intermediate seal 46, a second spacer 48, a first plate 52, a second plate 54, an inner seal 58, a connector 62, an igniter 66, and a plurality of fasteners 70. As described in greater detail, below the spacers 40, 48 and frame members 30, 32 provide means for supporting the plates 52, 54 in an opposed relationship while the seals 38, 46, 58 provide means for sealing the space between the plates 52, 54 (e.g., by forming a perimeter seal about the plates 52, 54) to form inlet/outlet chambers of the burner assembly 18.

In some embodiments, various components of the burner assembly 18 are sandwiched together to form a thin, generally vertical structure with the fasteners 70 securing the structure together. Generally, the first and second frame members 30, 32 (as well as the seals 38, 46 and spacers 40, 48) form a housing around the first and second plates 52, 54. As described in greater detail, the burner assembly 18 has an upper manifold 72 (FIG. 10) that is thin and oriented substantially vertically and a lower manifold 74 (FIG. 11) in communication with the upper manifold 72. The upper and lower manifolds 72, 74 are optionally described as closed plenums or chambers, for example with the lower manifold defining an inlet 76 into the manifolds 72, 74 and the upper manifold 72 defining an outlet 78 from the manifolds 72, 74.

Figure 3:
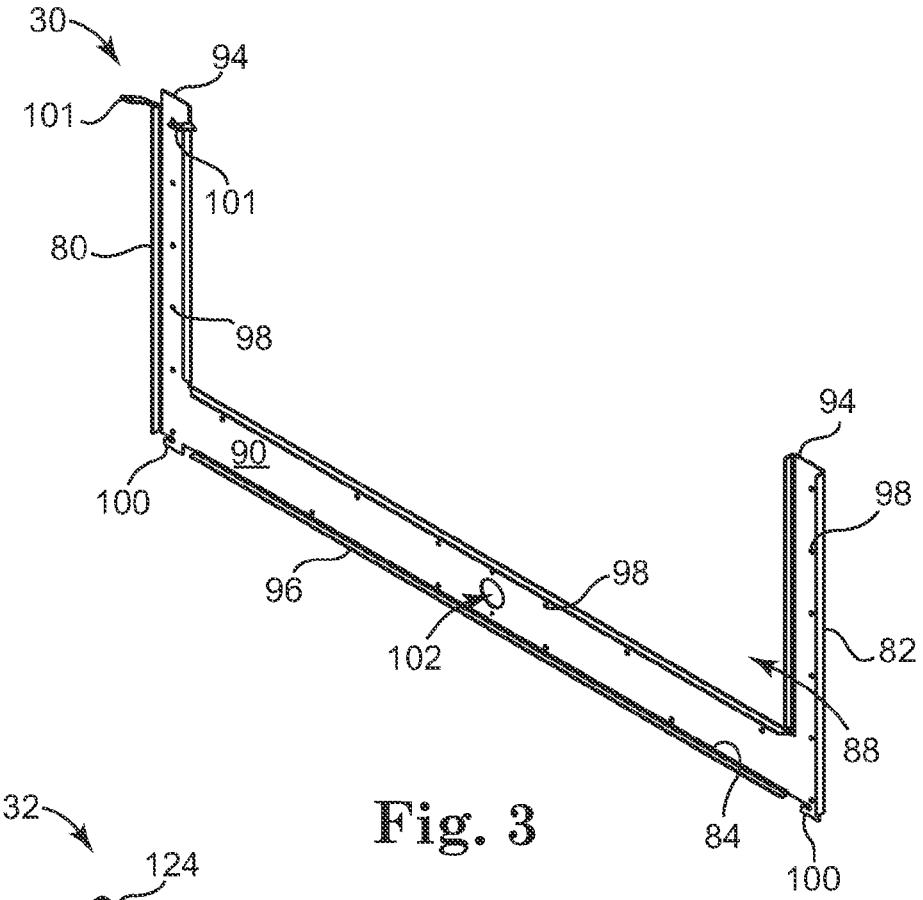
FIG. 3 is a perspective view of a first frame member of the burner assembly of FIG. 2, according to some embodiments.

FIG. 3 is a perspective view of the first frame member 30, according to some embodiments. As shown, the first frame member 30 includes a first upright 80, or first side portion, a second upright 82, or second side portion, and a lateral member 84 extending between the first and second uprights 80, 82, where the first upright 80, the second upright 82, and the lateral member 84 define a central viewing area 88. The first frame member 30 also defines an outer face 90, an inner face 92 (FIG. 10), an upper portion 94 and a lower portion 96, and has a plurality of fastener holes 98.

In some embodiments, the first frame member 30 includes a pair of feet 100 at the lower portion 96, of the first frame member 30 adapted for maintaining the burner assembly 18 (FIG. 1) in a substantially upright position (e.g., on a bottom portion of the combustion chamber 14). The inner face 92 of the first frame member 30 is optionally substantially planar overall. In some embodiments, the first upright 80 includes a pair of tabs 101 adapted to maintain the igniter 66. The lateral member 84 is optionally positioned at the lower portion 96 of the first frame member 30 and has an opening 102. In some embodiments, the opening 102 is about 1.25 inches in diameter.

Though a variety of materials and forming processes are contemplated, the first upright 80, the second upright 82, and the lateral member 84 are optionally formed from a single piece of sheet metal or other material using bending and/or stamping processes, for example. The first upright 80, the second upright 82, and the lateral member 84 combine to form a substantially U-shaped frame, where the central viewing area 88 is defined on three sides by the first upright 80, the second upright 82, and the lateral member 84 and is open at the upper portion 94.

Figure 4:
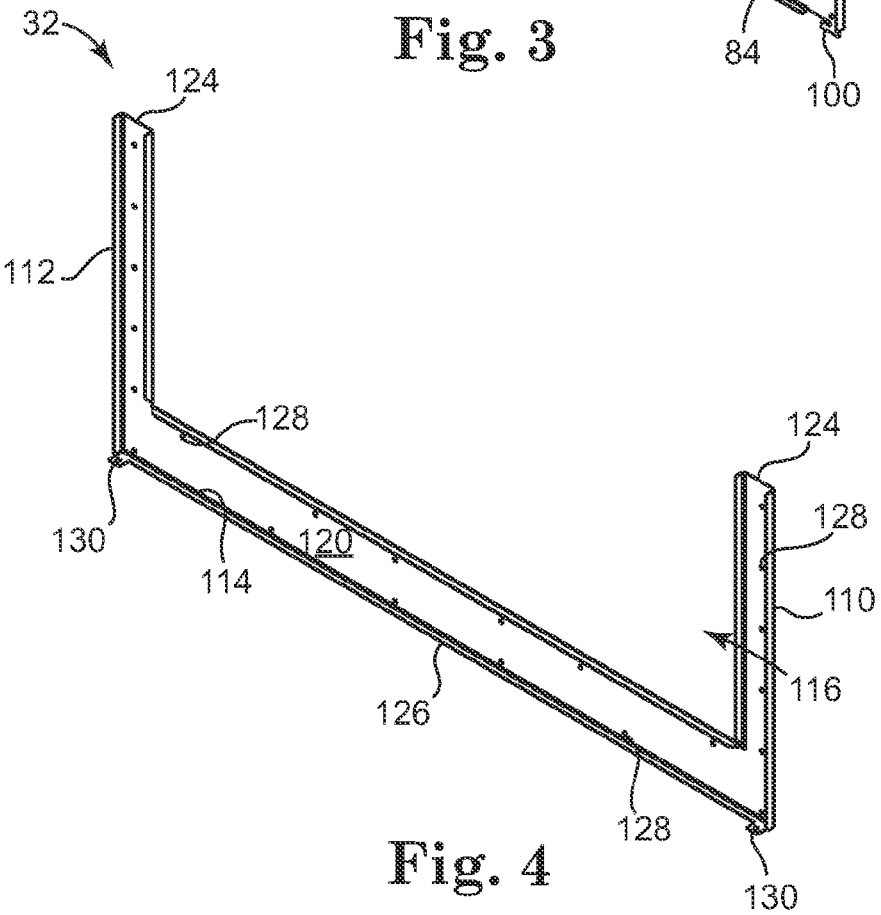
FIG. 4 is a perspective view of a second frame member of the burner assembly of FIG. 2, according to some embodiments.

FIG. 4 is a perspective view of the second frame member 32, according to some embodiments. As shown, the second frame member 32 is substantially complementary in configuration to the first frame member 30 and includes a first upright 110, or first side portion, a second upright 112, or second side portion, and a lateral member 114 extending between the first and second uprights 110, 112, where the first upright 110, the second upright 112, and the lateral member 114 define a central viewing area 116.

The second frame member 32 also defines an outer face 120, an inner face 122 (FIG. 10), an upper portion 124, and a lower portion 126 and has a plurality of fastener holes 128. The inner face 122 of the second frame member 32 is optionally substantially planar overall. The second frame member 32 includes a pair of feet 130 at the lower portion 96 of the second frame member 32 adapted for maintaining the burner assembly 18 (FIG. 1) in a substantially upright position (e.g., on the bottom portion of the combustion chamber 14). In some embodiments, similar forming processes and materials to those of the first frame member 30 are used to form the second frame member 32. The first upright 110, the second upright 112, and the lateral member 114 combine to form a substantially U-shaped frame, where the central viewing area 116 is defined on three sides by the first upright 110, the second upright 112, and the lateral member 114 and is open at the upper portion 124.

The various seals are shown and described below as pre-formed pieces (e.g., being molded, stamped, or cut out) of material. In some embodiments, however, one or more of the seals are deposited or applied as liquids or gels that cure or are otherwise formed.

Figure 5:
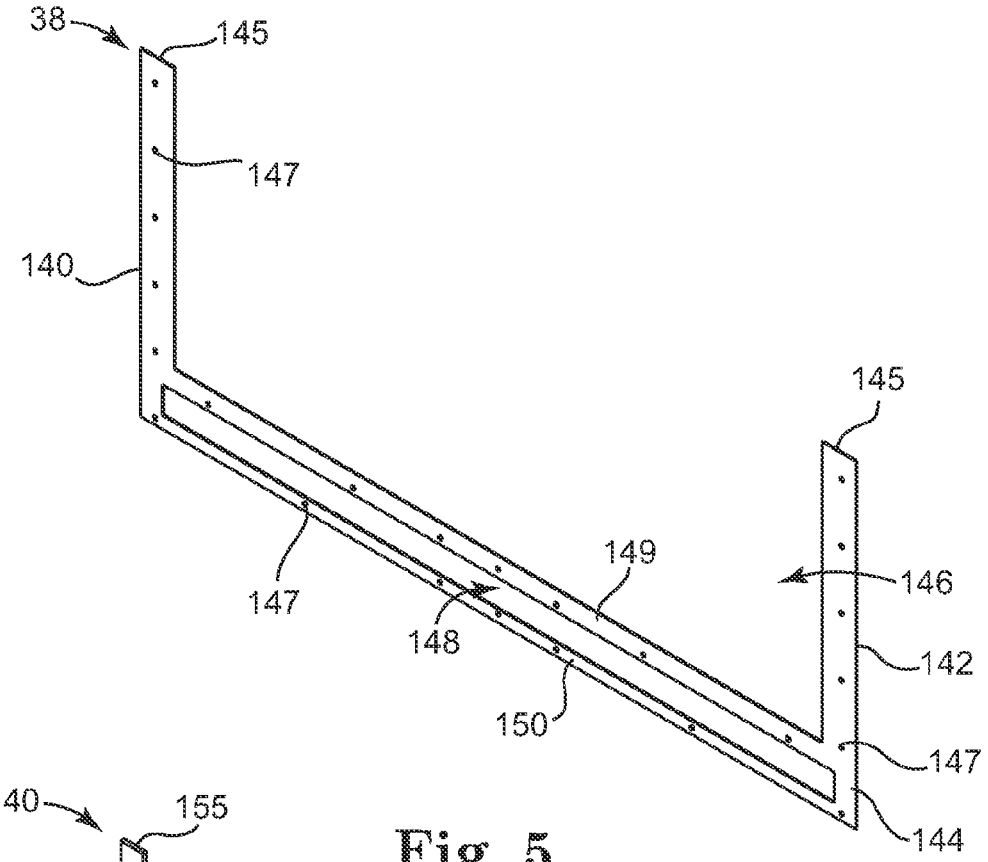
FIG. 5 is a perspective view of a first intermediate seal of the burner assembly of FIG. 2, according to some embodiments.

FIG. 5 is a perspective view of the first intermediate seal 38, according to some embodiments. The first intermediate seal 38 is optionally formed as a single piece of gasket material (e.g., high-temp silicone gasket material), or any other suitable material. In some embodiments, the first intermediate seal 38 is about 0.125 inches thick, although a variety of dimensions (e.g., from about 0.1 inches to about 0.8 inches thick) are contemplated. The first intermediate seal 38 includes a first arm 140, or first side portion, a second arm 142, or second side portion, and a lower body 144 connecting the first and second arms 140, 142. The first intermediate seal 38 also defines an upper portion 145. The first intermediate seal 38 is substantially U-shaped, for example, defining an open interior 146 bounded by the first arm 140, the second arm 142, and the lower body 144 and has a plurality of fastener holes 147 disposed about the first intermediate seal 38.

The lower body 144 has an opening 148 which, as described in greater detail below, helps provide means for forming a gas plenum. As shown, the opening 148 is substantially rectangular in shape and about 34.5 inches long and from about 1 to about 3 inches in height (e.g., about 2 inches in height), although a variety of shapes and dimensions are contemplated. The lower body 144 has an upper piece 149 above the opening 148 and a lower piece 150 below the opening 148. The open interior 146 is sized to be substantially smaller than the first plate 52 such that the first arm 140, the second arm 142, and the upper piece 149 are sized to overlap the first plate 52 as described in greater detail below.

The second intermediate seal 46 is substantially similar to the first intermediate seal 38, according to some embodiments. As such, where features of the second intermediate seal 46 are described and referenced in the drawings they are designated by a similar reference number to the first intermediate seal 38 followed by a "B."

Figure 6:
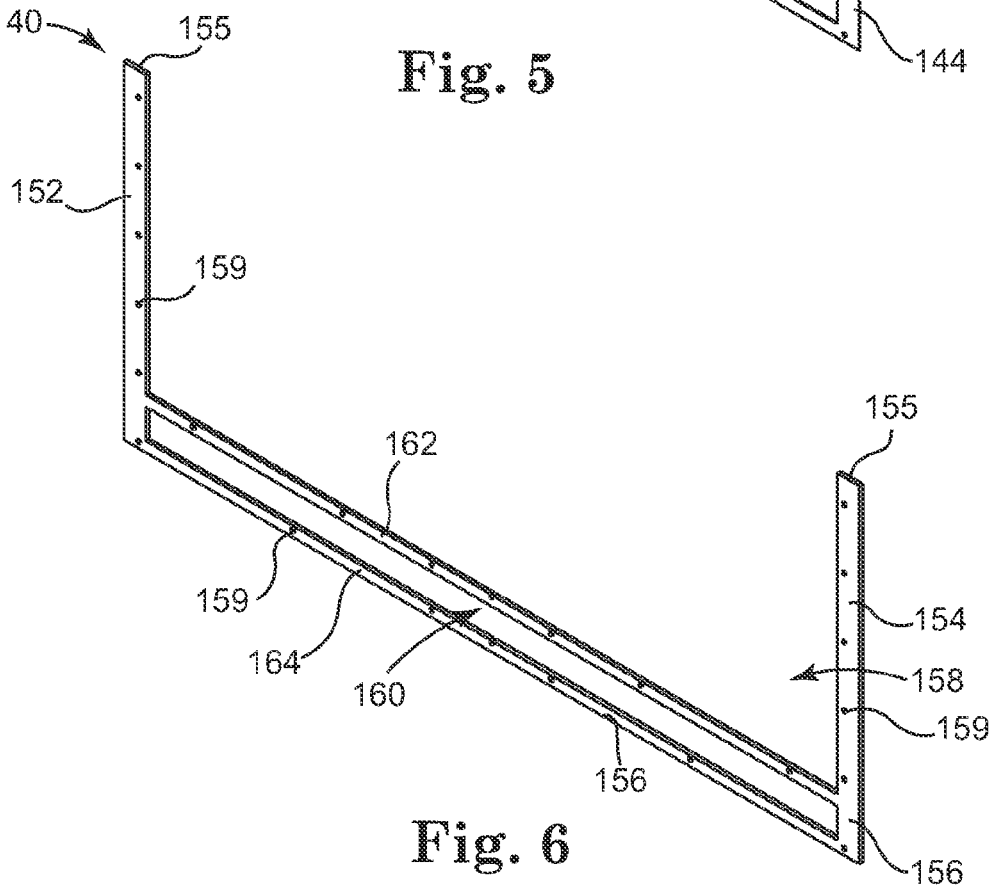
FIG. 6 is a perspective view of a first spacer of the burner assembly of FIG. 2, according to some embodiments.

FIG. 6 is a perspective view of the first spacer 40. The first spacer 40 is optionally formed as a single piece of material. In some embodiments, the first spacer 40 is adapted to support the first plate 52 and/or to provide anchor points for fastening the various burner components together without unduly stressing the first plate 52. For example, the first spacer 40 is formed of steel or another sufficiently rigid material (e.g., polymeric or metallic materials) for supporting the first plate 52 and/or providing suitable assembly anchor points. In some embodiments, the first spacer 40 is about 0.25 inches thick, although a variety of dimensions are contemplated (e.g., from about 0.1 to about 0.5 inches thick). In some embodiments, the first spacer 40 has about the same thickness as the first plate 52.

The first spacer 40 includes a first arm 152, or first side portion, a second arm 154, or second side portion, and a lower body 156 connecting the first and second arms 152, 154. The first spacer 40 also has an upper portion 155. In some embodiments, the first spacer 40 is substantially U-shaped, defining an open interior 158 bounded by the first arm 152, the second arm 154, and the lower body 156. The open interior 158 is sized to be substantially complementary in size to the first plate 52, such that the first plate 52 is able to be received in the open interior 158 in a substantially complementary fit. The first spacer 40 also includes a plurality of fastener holes 159 disposed about the first spacer 40.

The lower body 156 has an opening 160 which, as subsequently described, helps provide means for forming a lower manifold, or plenum of the burner assembly 18. As shown, the opening 160 is substantially rectangular in shape and about 34.5 inches long and about 2 inches high, although a variety of shapes and dimensions are contemplated (e.g., from about 1 inch to about 3 inches in height). The lower body 156 defines an upper piece 162 above the opening 160 and a lower piece 164 below the opening 160.

The second spacer 48 is substantially similar to the first spacer 40, according to some embodiments. As such, where features of the second spacer 48 are described and referenced in the drawings they are designated by a similar reference number to the first spacer 40 followed by a "B."

As shown in FIG. 2, in some embodiments, the first plate 52 is substantially rectangular in shape, having a length of about 35 inches, a height of about 14 inches, and a thickness of about 0.25 inches, although a variety of dimensions are contemplated (e.g., a plate thickness from 0.1 to about 0.5 inches). The first plate 52 is optionally formed of ceramic glass, or other suitable material.

In some embodiments, the first plate 52 is formed of a substantially transparent, or see-through material such that light is able to pass through the first plate 52. In other embodiments, the first plate 52 is formed of substantially reflective material (e.g., a material such as Mirropane™ available from Toledo-Pilkington North America Inc. of Toledo, Ohio) or other materials. In still other embodiments, the first plate 52 is formed of opaque materials, such as marble, porcelain, stone, metal, or others. The first plate 52 defines an outer face 180, an inner face 182 (FIG. 10), a top edge 184 along an upper portion 185 of the first plate 52, also described as a terminal edge, a bottom edge 186 along a lower portion 187 of the first plate 52, also described as a perimeter edge, a first side edge 188 along a first side portion 189 of the first plate 52, and a second side edge 190 along a second side portion 191 of the first plate 52.

In some embodiments, the inner and/or outer faces 180, 182 of the first plate 52 are substantially planar, where the inner and/or outer faces 180, 182 are optionally smooth (e.g., as with typical sheet glass) or include surface features (e.g., bumps, ridges, dimpling, facets, or other features) while being considered substantially planar. In some other embodiments, the inner and/or outer faces 180, 182 are not substantially planar (e.g., including larger-scale waves or bends). For example, the first and second plates 52, 54 are optionally substantially S-shaped and fit together, at a spaced relationship, in a complementary manner.

The second plate 54 is optionally substantially similar to the first plate 52, according to some embodiments. As such, where features of the second plate 54 are described and referenced in the drawings they are designated by a similar reference number to the first plate 52 followed by a "B." Each of the first and second plates is optionally described as panels, planer members, or sheets as desired.

Figure 7:
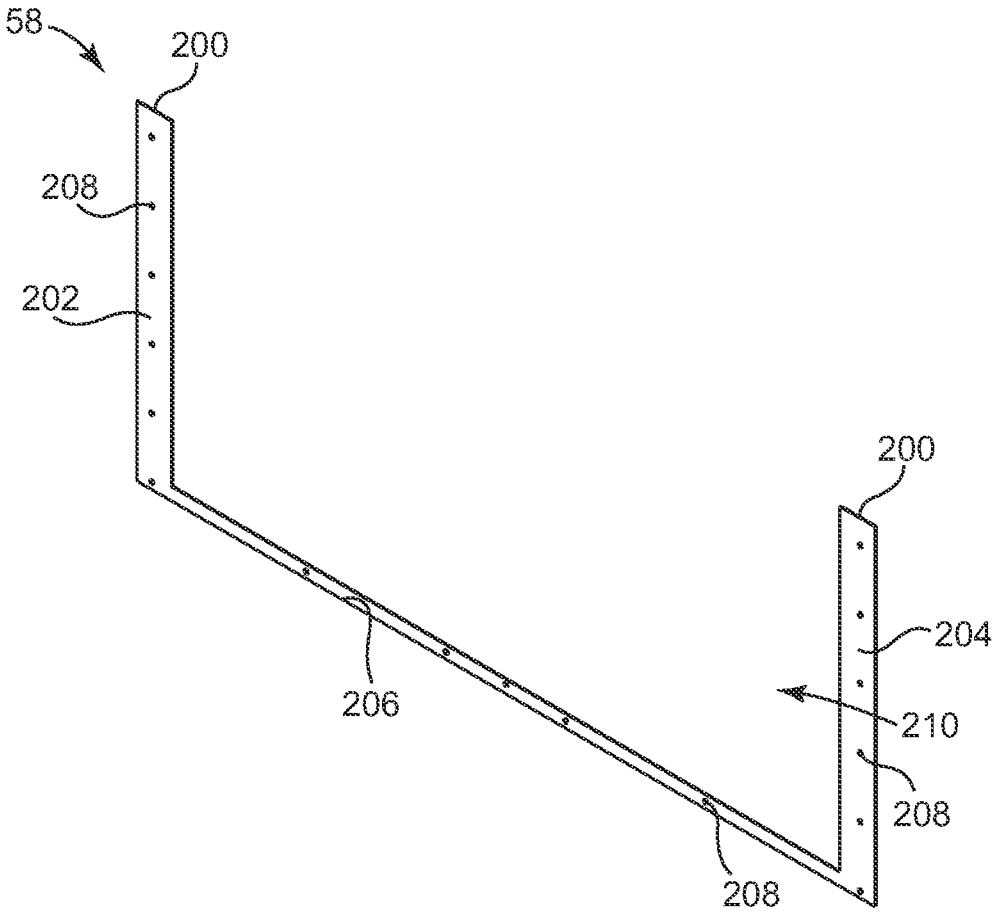
FIG. 7 is a perspective view of an inner seal of the burner assembly of FIG. 2, according to some embodiments.

FIG. 7 is a perspective view of the inner seal 58, according to some embodiments. The inner seal 58 is optionally formed as a single piece of gasket material, or any suitable material (e.g., high temp silicone gasket material). In some embodiments, the inner seal 58 is about 0.06 inches thick, although a variety of dimensions are contemplated (e.g., from about 0.01 inches to about 0.25 inches thick). The inner seal 58 has an upper portion 200 and includes a first arm 202, or first side portion, a second arm 204, or second side portion, and a lower body 206 connecting the first and second arms 202, 204. The inner seal 58 also includes a plurality of fastener holes 208 disposed about the inner seal 58.

The inner seal 58 is substantially U-shaped, defining an open interior 210 bounded by the first arm 202, the second arm 204, and the lower body 206. The open interior 210 is sized to be shorter than the first and second plates 52, 54 such that the first and second arms 202, 204 are sized to abut the first and second plates 52, 54 upon assembly of the burner assembly 18. In turn, the open interior 210 is substantially taller (or in alternate terms, wider) than the first plate 52 to leave space under the first and second plates 52, 54. In particular, the first and second arms 202, 204 are adapted to overlap the first plate 52 while the lower body 206 resides below the first and second plates 52, 54 at an offset from the bottom edges 186, 186B of the first and second plates 52, 54. In some embodiments, the lower body 206 is about 0.6 inches in height, for example.

As shown in FIG. 2, in some embodiments the connector 62, also described as a conduit, includes a tubular, hollow body 211, or tubular member, and a flange 212 secured at one end of the body 211. The body 211 includes an elbow bend 214 proximate the flange 212 and is slotted at an opposite end, for example, to facilitate use of an air-to-gas mixture control means.

As shown in FIG. 2, in some embodiments the igniter 66 includes a spark generation probe or probes 220 and is generally adapted to ignite combustible gases and gas/air mixtures. The igniter 66 is adapted to be mounted to the pair of tabs 101 of the first frame member 30. The igniter 66 is connected to a suitable power source and controller (not shown) for timing and other ignition system control.

Figure 8:
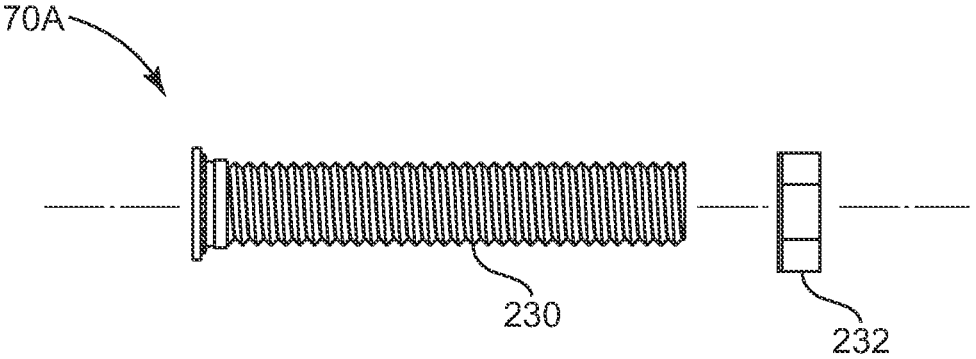
FIG. 8 is a side view of a fastener of the burner assembly of FIG. 2, according to some embodiments.

FIG. 8 shows a first fastener 70A of the plurality of fasteners 70. As shown, the first fastener 70A includes a body portion 230 and a complementary head portion 232. The first fastener 70A is optionally adapted to be self locking and secured in a bolt-and-nut fashion, though a variety of fasteners, including adhesives, for example, are also contemplated. Each of the plurality of fasteners 70 is optionally substantially similar to the first fastener 70A, according to some embodiments.

Figure 9:
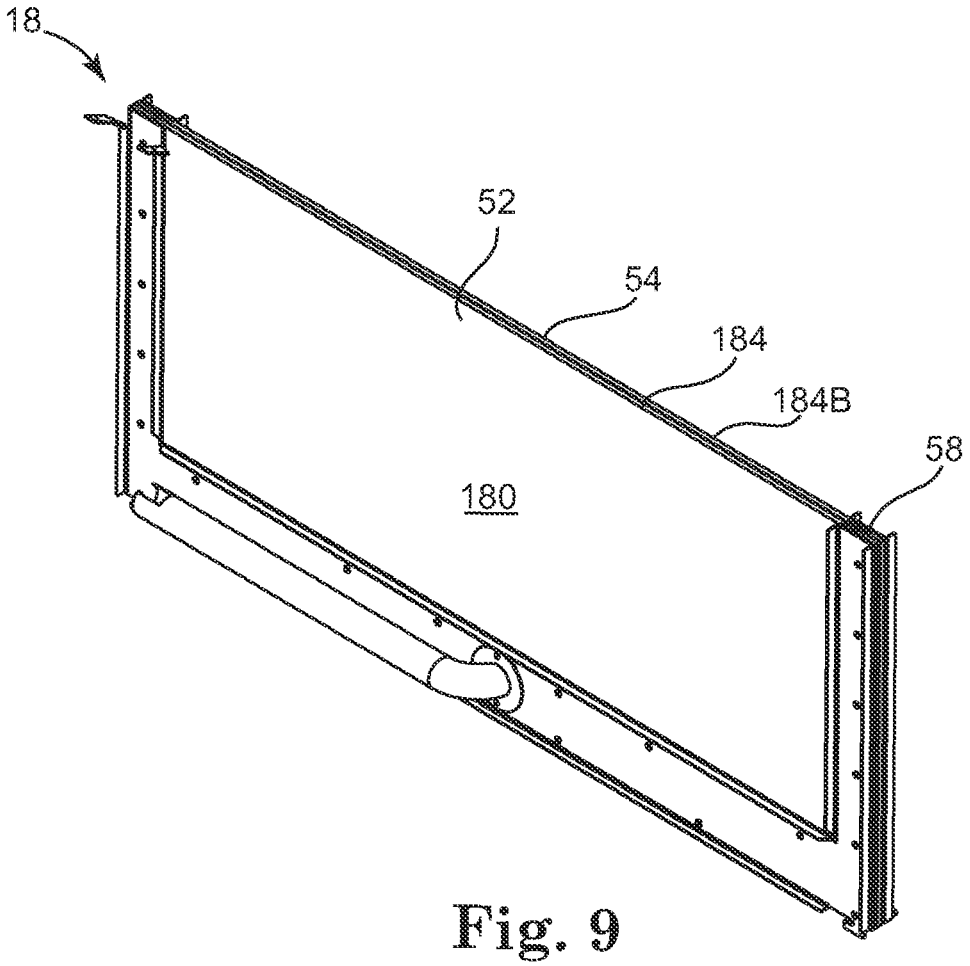
FIG. 9 is a perspective view of the burner assembly of FIG. 2 in an assembled state, according to some embodiments.
Figure 10:
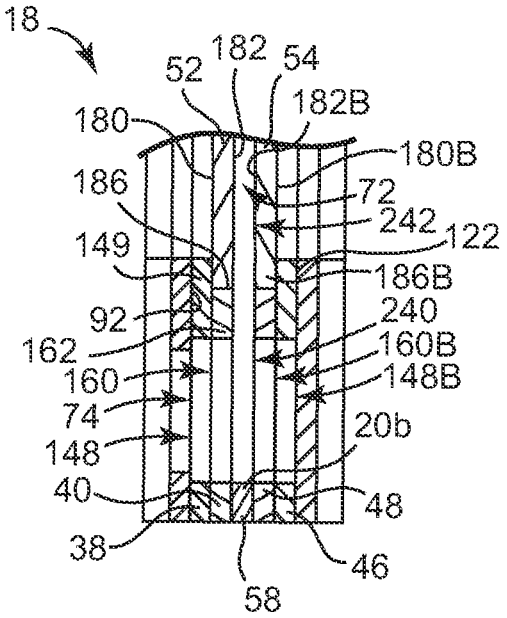
FIG. 10 is a cross-sectional view of a portion of the burner assembly along line 10-10 of FIG. 1, according to some embodiments.
Figure 11:
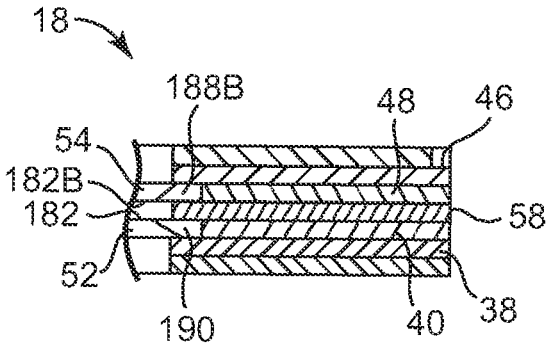
FIG. 11 is a cross-sectional view of a portion of the burner assembly along line 11-11 of FIG. 1, according to some embodiments.

FIG. 9 is a perspective view of the burner assembly 18 of FIG. 2 in an assembled state. FIG. 10 is a cross-sectional view of a portion of the burner assembly 18 without the connector 62 along line 10-10 shown in FIG. 1 and FIG. 11 is another cross-sectional view of a portion of the burner assembly 18 along line 11-11 shown in FIG. 1. Reference can be made between the unassembled, or exploded view of FIG. 2 and the assembled views of FIGS. 9-11 as appropriate to assist in understanding some methods of assembling the burner assembly 18.

In some embodiments, assembly includes disposing the first and second plates 52, 54 in a substantially parallel, spaced relationship with the inner seal 58 disposed between the first and second plates 52, 54. The inner seal 58 is optionally substantially compliant and helps reduce the effects of irregularities, misalignment, and/or stress concentrations on the plates 52, 54. Where the plates 52, 54 are formed of glass or other ceramic material, such compliance is useful to prevent cracking of the plates 52, 54, although the first and second spacers 40, 48 also optionally assist in this regard.

In some embodiments, the inner seal 58 is abutted against the inner face 182 of the first plate 52 and inner face 182B of the second plate 54, respectively such that the inner seal 58 runs along the first and second side edges 188, 190 of the first plate 52 and first and second side edges 188B, 190B of the second plate 54. The upper portion 200 of the inner seal 58, the top edge 184 of the first plate 52, and top edge 184B of the second plate 54 are substantially aligned with one another and the lower body 206 of the inner seal 58 is positioned below the bottom edge 186 of the first plate and bottom edge 186B of the second plate 54 to define an opening 240 forming part of the lower manifold 74 and being in communication with the upper manifold 72 as shown in FIG. 10.

In some embodiments, the first spacer 40 receives the first plate 52 in the open interior 158 (FIG. 2) of the first spacer 40. In turn, the second spacer 48 similarly receives the second plate 54 in the open interior 158B (FIG. 2) of the second spacer 48. In some embodiments, the first and second plates 52, 54 generally rest on the first and second spacers 40, 48, respectively. The plates 52, 54 and spacers 40, 48, respectively, form a generally complementary fit as desired, although some play or tolerance is optionally provided in such a fit to account for thermal expansion, assembly misalignment, or other considerations.

In some embodiments, the first intermediate seal 38 is abutted against the outer face 180 of the first plate 52, as well as the first spacer 40, and the second intermediate seal 46 is abutted against the outer face 180B of the second plate 54, as well as the second spacer 48. In particular, the intermediate seals 38, 46 are abutted against the first and second plates 52, 54, respectively, toward the outer perimeters of each of the first and second plates 52, 54. The upper portion 145 of the first intermediate seal 38 and the upper portion 145B of the second intermediate seal 46 are generally aligned with the top edges 184, 184B of the first and second plates 52, 54, respectively. In turn, the openings 148, 148B of the first and second intermediate seals 38, 46 are aligned with each other and are positioned below the bottom edges 186, 186B of the first and second plates 52, 54.

As shown in FIG. 10, in some embodiments, the openings 148, 148B of the first and second intermediate seals 38, 46; the openings 160, 160B of the first and second spacers 40, 48; and the opening 240 combine to define the lower manifold 74 and the spacing, or gap 242, between the first and second plates 52, 54 defines the upper manifold 72 and the outlet 78. In some embodiments, the thickness of the inner seal 58 is selected to control the thickness of the gap 242. For example, the thickness of the inner seal 58 is optionally substantially uniform such that the gap 242 is substantially vertical in orientation and is substantially uniform, or continuous in thickness.

In some embodiments, the outer, side edges 188, 188B and 190, 190B are sealed such that a substantially thin, vertical chamber—the upper manifold 72—is formed between the first and second plates 52, 54; a thin, elongate inlet into the upper manifold 72 is formed, or otherwise defined, along the bottom edges 186, 186B of the first and second plates 52, 54; and the outlet 78 from the upper manifold 72 formed, or otherwise defined, along the top edges 184, 184B. In particular, a substantial perimeter portion of the first and second plates 52, 54 is sealed together to form the upper manifold 72 with the gap 242 defined between the first and second plates 52, 54.

In some embodiments, the gap 242 is substantially elongate and continuous at the top edges 184, 184B of the first and second plates 52, 54 such that the outlet 78 is substantially continuous and elongate. The gap 242 is optionally substantially continuous between the first and second plates 52, 54 (from top-to-bottom and from side-to-side), although non-uniform spacing between the first and second plates 52, 54 is also contemplated (e.g., a top profile of the gap 242 at the top edges 184, 184B is substantially thin and rectangular according to some embodiments, although a gap that increases in thickness along its length, or sinusoidal, jagged, or other profiles are contemplated to modify flame shape and/or other flame and visual characteristics).

In some embodiments, the outlet 78 extends without interruption for a length of about 33.5 inches at the top edges 184, 184B at a thickness of about 0.06 inches, for example, although a variety of dimensions are contemplated. For example, in some embodiments, the outlet 78 is less than about 0.5 inches thick. In some other embodiments, outlet thicknesses from about 0.03 inches to about 0.125 inches or from about 0.01 inches to about 0.25 inches is contemplated. A variety of lengths are also contemplated, including the outlet 78 extending continuously without interruption for greater than about 1 inch, for greater than about 3 inches, from about 3 inches to about 48 inches, greater than about 12 inches, or greater than about 24 inches, for example.

In some embodiments, the upper manifold 72 is from about 3 inches long to about 48 inches long, is from about 3 inches in height to about 36 inches in height, and is from about 0.03 inches in thickness, or depth, to about 0.125 inches in thickness or from about 0.01 inches in thickness to about 0.25 inches in thickness, for example. In turn, the lower manifold 74 is from about 1 inches in height to about 3 inches in height; is from about 0.25 inches in thickness to about 2 inches in thickness; and is from about 3 inches long to about 48 inches long, for example, although a variety of dimensions are clearly contemplated.

As shown in FIG. 10, the inner face 92 of the first frame member 30 is abutted against the first intermediate seal 38, and the inner face 122 of the second frame member 32 is abutted against the second intermediate seal 46. In some embodiments, the outer perimeters of the first and second frame members 30, 32; the first and second intermediate seals 38, 46; the first and second spacers 40, 48; the first and second plates 52, 54; and the inner seal 58 each are substantially aligned with one another. In particular, the fastener holes 98, 128 (FIG. 2) of the first and second frame members 30, 32; the fastener holes 147, 147B of the first and second intermediate seals 38, 46; the fastener holes 159, 159B of the first and second spacers 40, 48; and the fastener holes 208 of the inner seal 58 are all aligned with one another such that the plurality of fasteners 70 are inserted through corresponding fastener holes to secure the burner assembly 18 together.

The connector 62 is secured to the opening 102 of the first frame member 30. In particular, the flange 212 (FIG. 2) is secured to the outer face 90 to place the connector 62 in communication with the lower manifold 74 (FIG. 10) and, thus, the upper manifold 72. The igniter 66, or ignition device, is mounted to the pair of tabs 101 of the first frame member 30 adjacent the outlet 78 and is adapted to ignite combustible gases emanating from the outlet 78. In other embodiments, however, the igniter 66 or an additional or alternate ignition device is mounted in the path of combustible gases into the burner assembly 18 prior to the gases entering the burner assembly 18 such that flames 22 travel up into the upper manifold 72 and/or lower manifold 74. For example, in some embodiments, the igniter 66 is optionally mounted in the path of gas flow between the gas source 16 and the lower manifold 74. The flames 22 are viewable in the upper manifold 72 through the first and second plates 52, 54 according to some embodiments.

As shown in FIG. 1, positioning of the burner assembly 18 in the fireplace 10 according to some embodiments includes releasably securing the feet 100 (FIG. 3) and 130 (FIG. 4) of the burner assembly 18 into a lower portion of the combustion chamber 14 such that the burner assembly 18 is substantially vertically oriented. In some embodiments, the burner assembly 18 is positioned in the fireplace 10 with the top edges 184, 184B of the first and second plates 52, 54 disposed in a middle portion 300 of fireplace 10, such that the first and second plates 52, 54 are exposed through a transparent portion 24 of the fireplace 10 while a remainder of the burner assembly 18 is substantially hidden from view by a surrounding, non-transparent portion 24B of the fireplace 10.

The connector 62 is placed in communication with the gas source 16, including any flow regulators, means for varying air-to-gas mixture ratios, or other equipment feeding the burner assembly 18 through the connector 62.

Where the first and second plates 52, 54 (FIG. 2) are substantially transparent, the visibility of the burner assembly 18 is greatly reduced, such that the burner assembly 18 is substantially hidden from view. For example, where the first and second plates 52, 54 are formed of a substantially clear material, light is able to pass through the central viewing area 88, into the first and second plates 52, 54, and out through the central viewing area 88B.

In some embodiments, this lends an appearance that a source of the flames 22 is substantially hidden. This hidden-source feature is useful in various scenarios, including creating a more realistic look with a log set or an eye-catching visual effect like that generally shown in FIGS. 1 and 12. In some embodiments, the top edges 184, 184B (FIG. 2) of the first and second plates 52, 54 define a light (i.e., harder to perceive) visual horizon with the first and second plates 52, 54 being transparent and less visible. In other embodiments, the top edges 184, 184B are not generally visible to the naked eye.

In some embodiments, the burner assembly 18 is used in a method of producing the flames 22 to produce a substantially continuous, uninterrupted body of flames 22 extending across the outlet 78 at the top edges 184, 184B. In contrast to burners with a multitude of distinct holes for delivering combustible gases, the burner assembly 18 optionally provides a single, substantially thin and elongate outlet 78 from the burner assembly 18 for generating the flames 22. For example, the gap 242 and resulting outlet 78 are optionally selected to provide means for forming a substantially continuous body of flames 22 across the upper portion of the burner assembly 18. It should also be understood that a spacing, length, and shape (e.g., top profile) of the gap 242 and outlet 78 are selected to provide various BTUs from the burner assembly 18 as desired.

In some embodiments, the burner assembly 18 is used to create an effect whereby the flames 22 race from the first side 26 of the burner assembly 18 to the second side 28 of the burner assembly 18. In particular, by locating the igniter 66 at the first side 26 of the burner assembly 18 the flames 22 start at the first side 26 and travel to the second side 28.

In still other embodiments, an additional igniter 66 is placed at the second side 28 of the burner assembly 18 to provide further versatility in a direction the flames 22 travel across the outlet 78 (e.g., left-to-right, right-to-left, and/or meeting-in-the-middle effects).

Figure 12:
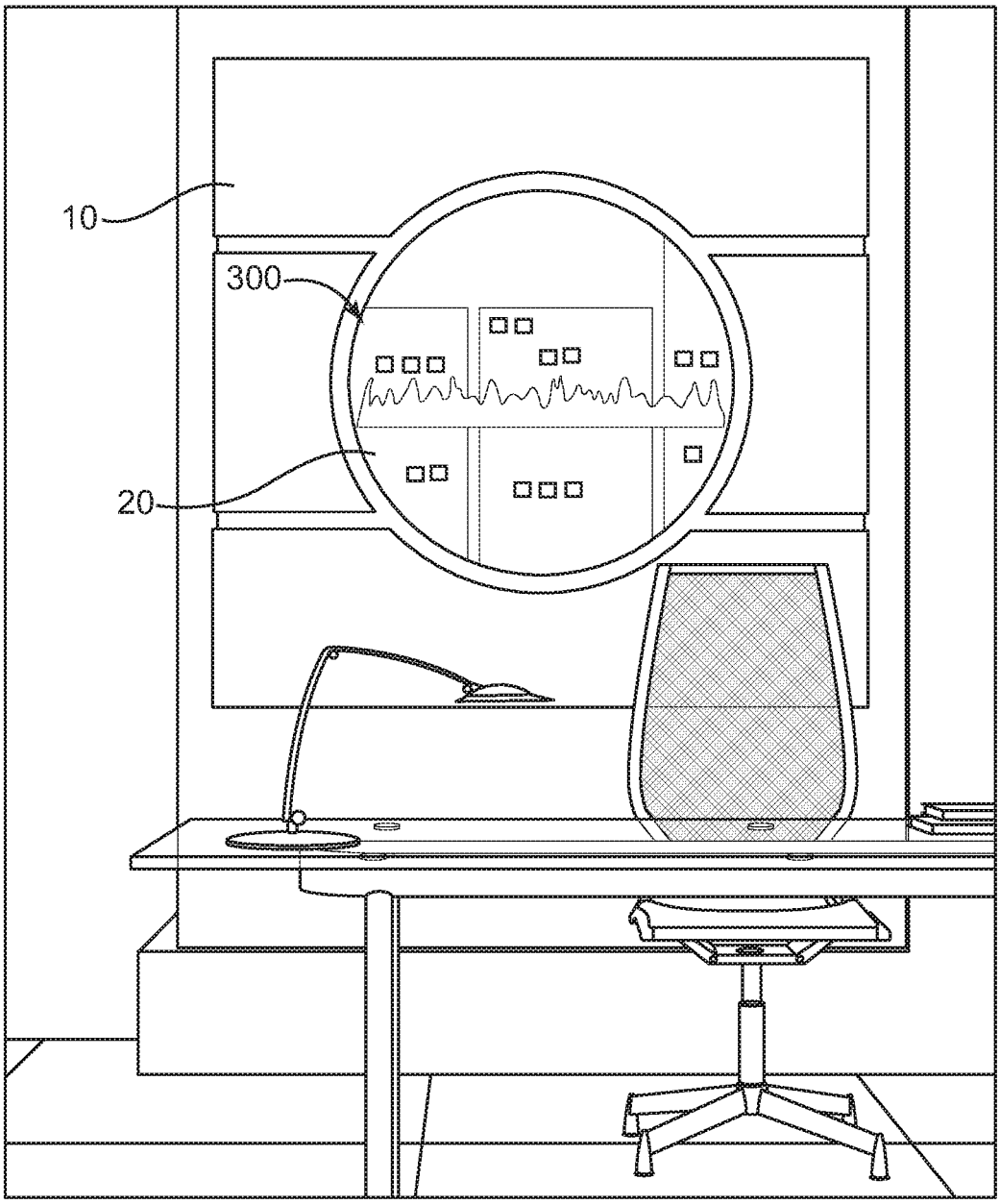
FIG. 12 is a front view of the fireplace of FIG. 1 installed in a wall, according to some embodiments.

FIG. 12 is a front view of the fireplace 10 illustrating one visual effect accomplished according to various embodiments—a see-through effect where the burner 18 is substantially see-through and hidden from view. As shown in FIG. 12, a viewer (not shown) is able to see into the combustion chamber 20, through the fireplace 10 (including the burner 18), and to the other side of the fireplace 10. The visual impact of the burner 18 (FIG. 1) is substantially reduced such that the burner 18 is substantially hidden and the flames 22 "appear in mid-air." From this description, a variety of variations and augmentations of such see-through viewing effects should become apparent.

Figure 13:
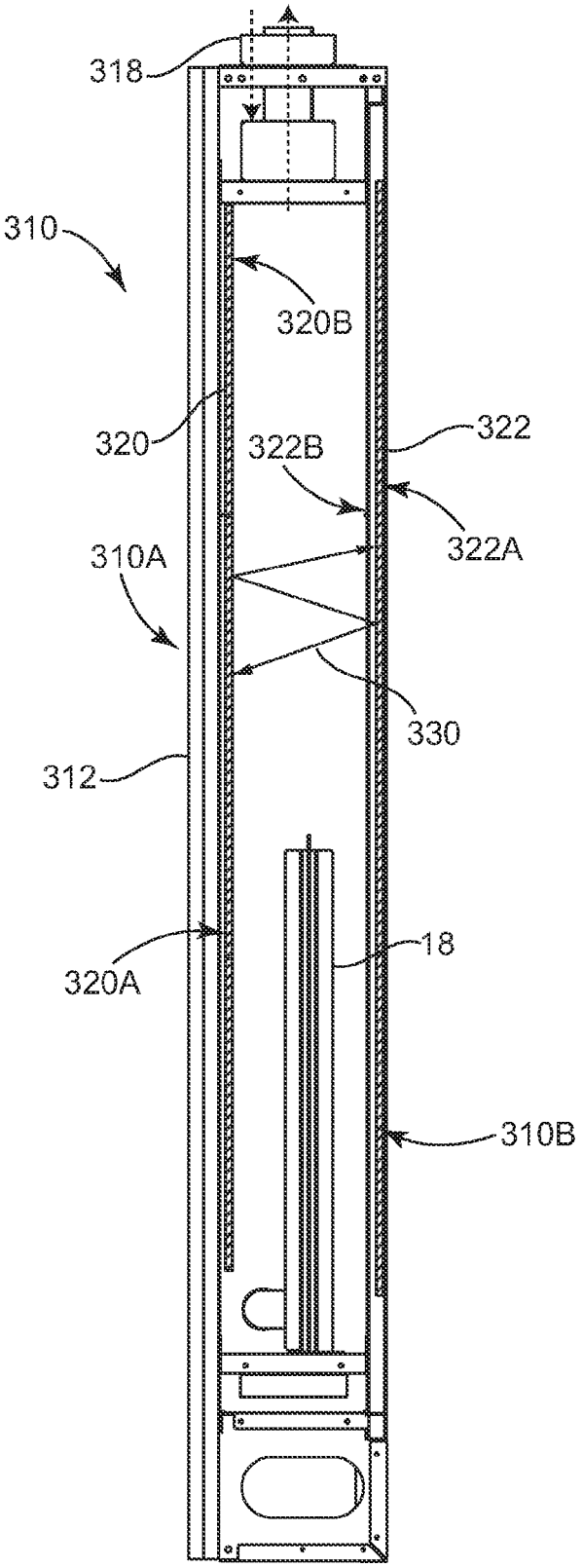
FIG. 13 is a side, cut away view of another fireplace, according to some embodiments.

FIG. 13 is a side view of another fireplace 310, according to some embodiments. In various embodiments, features described in association with the fireplace 10 and the fireplace 310 are interchangeable as desired. In some embodiments, the fireplace 310 includes a housing 312, a vent assembly 318, a front panel 320, a rear panel 322, and the burner assembly 18. In some embodiments, a viewer is able to view fireplace flames (not shown) by looking into the fireplace 310 from a first side 310A and/or a second side 310B of the fireplace, where the at least one of the front and rear panels 320, 322 allow viewing into the fireplace 310.

As shown, the fireplace 310 has a substantially thin profile, although thicker, more traditional fireplace designs are contemplated. In some embodiments the fireplace 310 includes features for creating reflective visual effects. For example, one or both of the front and rear panels 320, 322 are optionally formed of a reflective material, such as a one-way reflective material (e.g., Mirropane™ materials available from Toledo-Pilkington North America Inc. of Toledo, Ohio).

In some embodiments, the front panel 320 includes an outer surface 320A and in inner surface 320B, the front panel 320 being reflective at the inner surface 320B and allowing viewing into the fireplace 310 through the outer surface 320B. In some embodiments, the rear panel 322 includes an outer surface 320A and an inner surface 320B having substantially similar properties to those of the front panel 320, where the outer surface 322A allows viewing into the fireplace 310 and the inner surface 322B provides reflective properties. In still other embodiments, the inner surface 322B is reflective and the outer surface 322A is substantially opaque. As shown, the inner surfaces 320B, 322B of the front and rear panels 320, 322 are oriented inwardly, toward one another and the outer surfaces 320A, 322B face away from one another.

In some embodiments, light from fireplace flames generated by the burner 18 (not shown) is reflected back and forth by the reflective inner surfaces 320B, 322B as represented by the arrow 330 to create a reflective visual effect, such as an "infinity effect." In particular, in some embodiments, the fireplace 310 is adapted to create an illusion of depth using the infinity effect, where to a viewer it appears there are a series of layers of flames emanating from within the fireplace 310 due to the repeated reflection of the flames by the inner surfaces 320B, 322B. Thus, one method of presenting fireplace flames to a user for viewing includes optically reflecting flames to create the illusion of a plurality of flames within the fireplace 310 that are not otherwise actually present. In some embodiments, the optical effect shifts and moves depending on the viewer's viewing angle. Additionally, the inner surfaces 320B, 322B are optionally substantially parallel with one another, or can be angularly offset to vary a generated optical, or visual effect as desired.

Viewing panels having reflective properties can be utilized to achieve a variety of other, additional or alternative effects. For example, in some other embodiments, one or both of reflective surfaces 320B, 322B are oriented outwardly, toward a user, and the front and/or rear panels 320, 322 are adapted such that when turned off, a viewer sees an external, reflective surface substantially similar to a mirror, for example. When turned on, however, the front and/or rear panels 320, 322 become substantially see-through due to the internal light generated by the flames, allowing viewing of the flames generated in the fireplace 310. Thus, in one method of using the fireplace 310, the interior of the fireplace 310 is substantially obscured from view as desired (e.g., when not in operation) and, for example, even though a room in which the fireplace 310 is installed is illuminated. Additionally or alternatively, an internal light set (e.g., including light bulbs) is optionally used inside the fireplace to illuminate the interior and allow viewing through the reflective surface(s).

Figure 14:
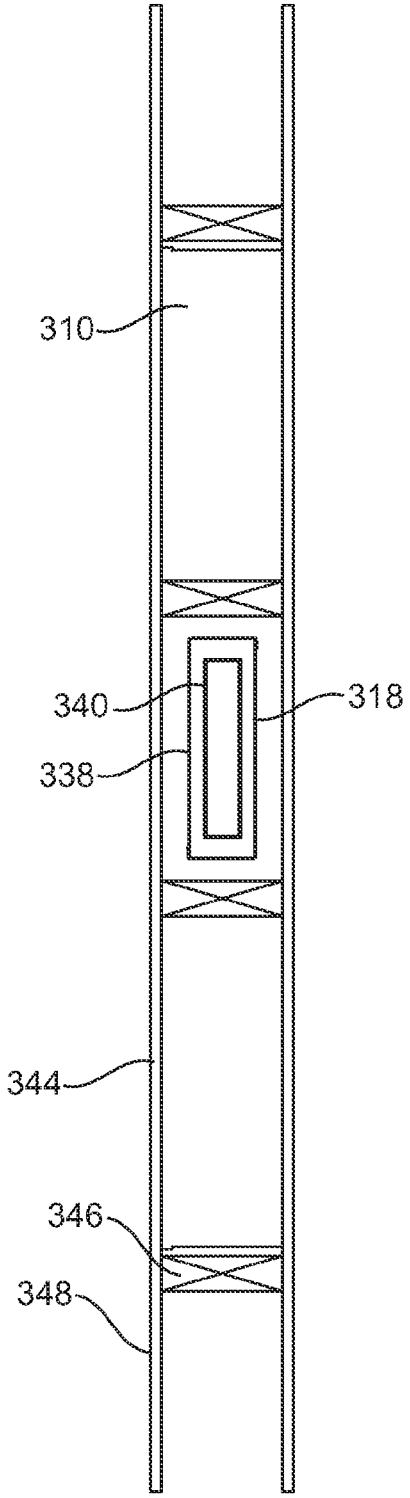
FIG. 14 is a top view of a fireplace of FIG. 13 installed in a wall, according to some embodiments.

FIG. 14 is a top view of the fireplace 310, according to some embodiments, where the vent assembly 318 includes an outer duct member 338 and an inner duct member 340 centrally disposed within the outer duct member 338. Although in FIG. 13, the vent assembly 318 is shown as being cut off, the vent assembly 318 optionally includes a short, vent connector secured to the fireplace 310 as well as a longer run of associated duct work having a substantially similar configuration to that of the vent connector (inner and outer duct members having similar sizes and shapes to that of the vent connector).

In some embodiments, the vent assembly 318 is particularly useful for installation in a relatively thin wall 344. Generally, the wall 344 is formed by a plurality of structure members 346 (e.g., wall studs) and appropriate facing members 348 (e.g., dry wall). The outer and inner duct members 338, 340 are substantially rectangular in shape, helping to allow the outer profile of the vent assembly 318 to be reduced while retaining sufficient air flow space (e.g., relative to traditional, round vent assembly designs). In particular, the outer and inner duct members 338, 340 each define a substantially thin rectangular profile and are secured relative to one another to form an air gap between them. In some embodiments, the air gap between the outer and inner duct members 338, 340 acts as a plenum for supplying fresh air into the fireplace 310 and the inner duct 340 provides a plenum for taking exhaust air out of the fireplace 310, the vent assembly 318 being in communication with a combustion chamber of the fireplace 310 and air supply plenum(s) of the fireplace 310.

In some embodiments, the vent assembly 318 is adapted to be installed in wall 344 having an open interior about 5.5 inches thick, for example, such as that formed using a standard 2 inch×6 inch wall stud configuration. In particular, the dimensions of the outer duct 338 and inner duct 340 are selected to allow sufficient spacing between structure members 346 and facing members 348 of the wall 344 to prevent overheating or address other building and safety concerns, while providing sufficient air flow into and out of the fireplace 310.

In view of the foregoing, in some embodiments the fireplace 10 is optionally substantially thin, overall, and installed in a standard wall 344 (e.g., a 2×6 stud wall) with the narrow vent assembly 318 being hidden within the wall 344. If desired, the fireplace 10 includes the middle portion 300 of the fireplace being substantially transparent from front-to-back, as well as the first and second plates 52, 54 being substantially transparent, such that the fireplace 10 provides a viewing window through the wall 344 (shown with buildings in the background) that is at least largely unobscured by the burner assembly 18 as shown in FIG. 12.

Figure 15:
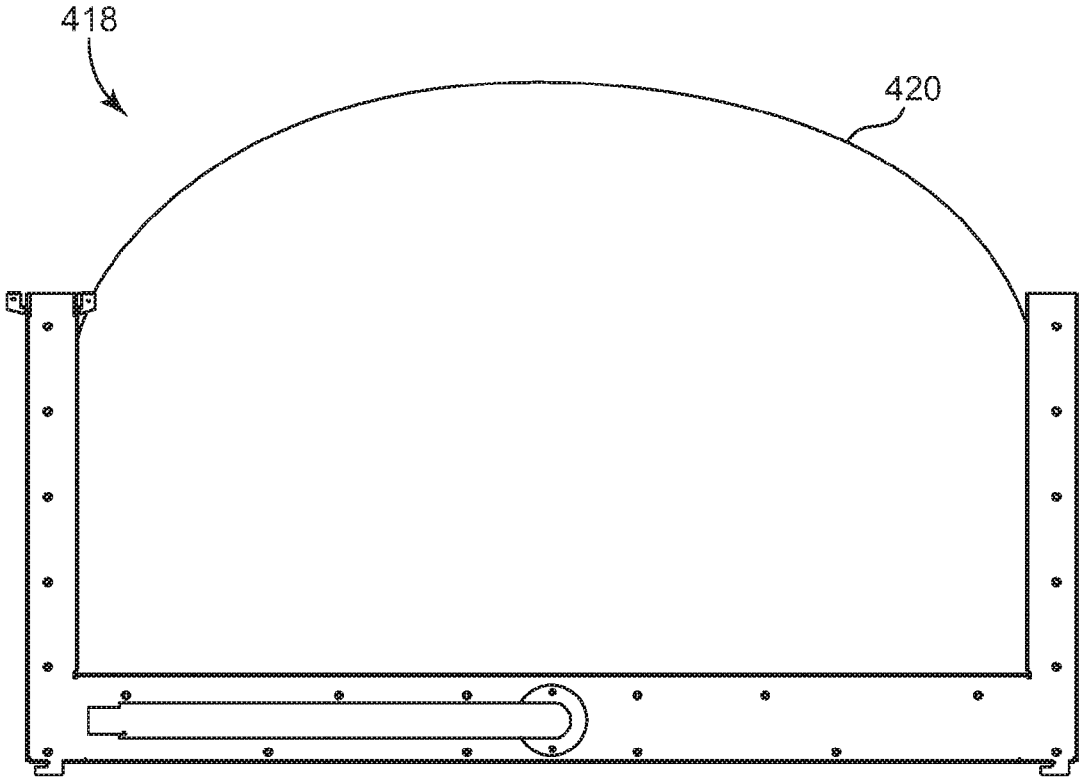
FIG. 15 is a front view of a burner assembly, according to some embodiments.
Figure 16:
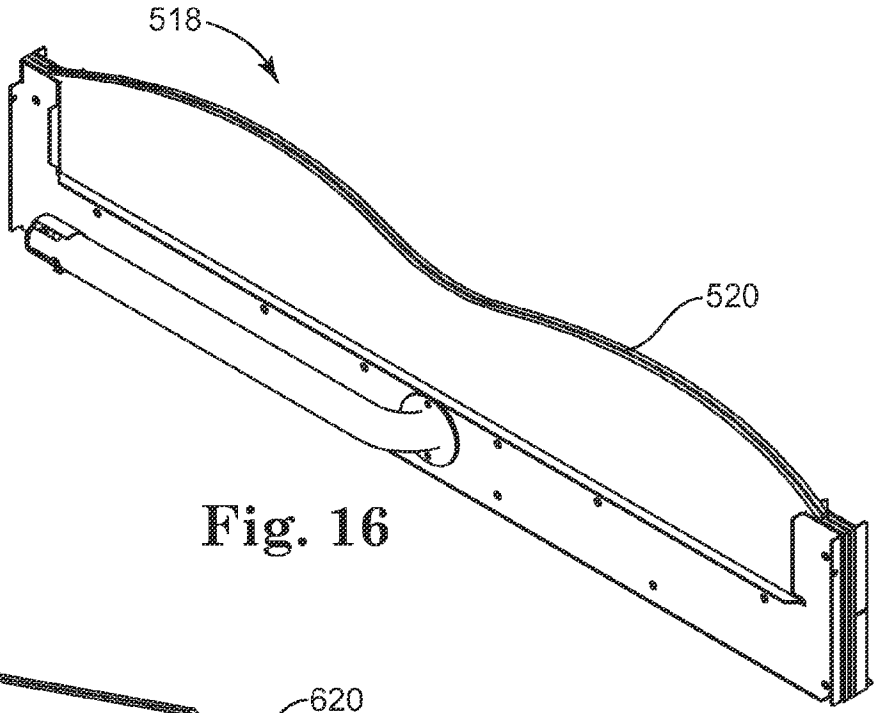
FIG. 16 is a perspective view of a burner assembly, according to some embodiments.
Figure 17:
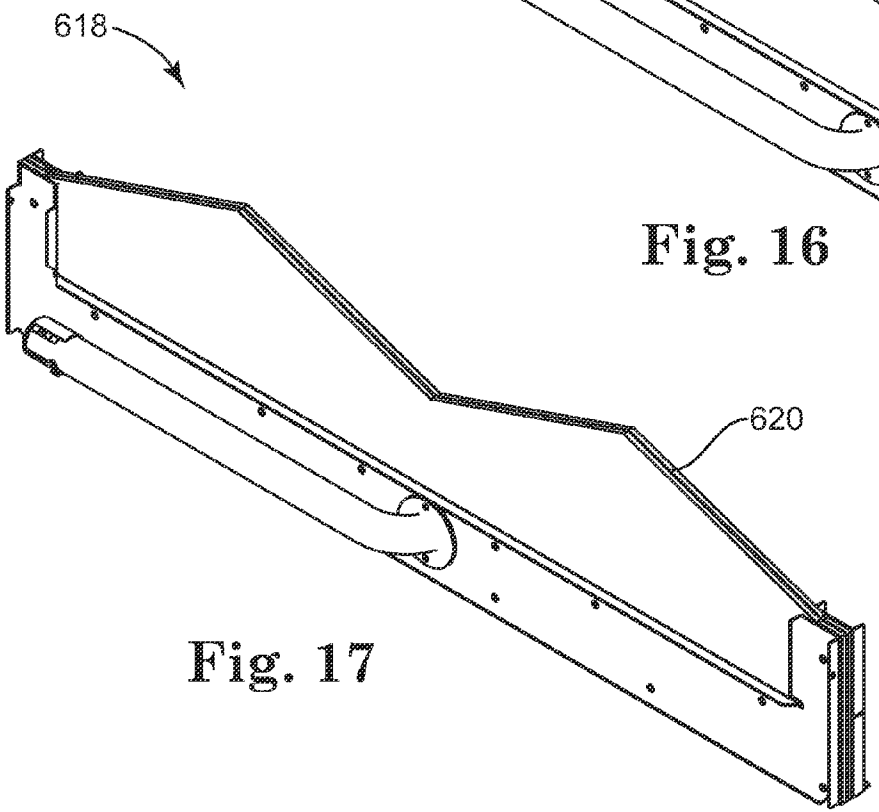
FIG. 17 is a perspective view of a burner assembly, according to some embodiments.
Figure 18:
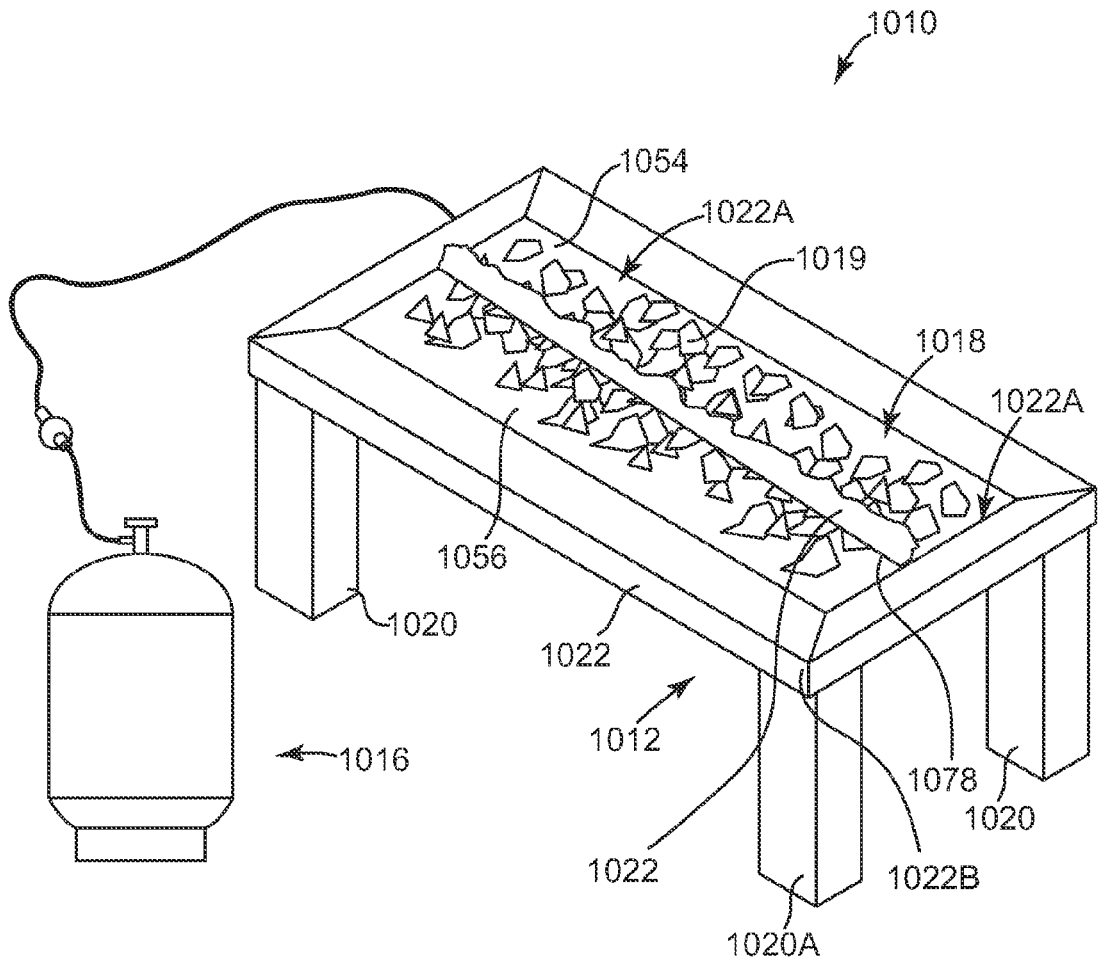
FIG. 18 is a perspective view of a heating unit, according to some embodiments.

Although the burner assembly 18 is shown and described with substantially rectangular first and second plates 52, 54, in other embodiments the plates 52, 54 take a variety of shapes. For example, another burner assembly 418 is shown in FIG. 15 having substantially arcuately shaped plates (only a first plate 420 is visible in FIG. 15) where flames (not shown) would be emitted along a substantially elongate arcuate path. As another example, FIG. 16 shows another burner assembly 518 with plates 520 defining a double curve profile where flames (not shown) would be emitted along a substantially elongate, double curve profile. As still another example, FIG. 18 shows another burner assembly 618 with plates 620 having an angular, double peaked profile where flames (not shown) would be emitted along substantially elongate, double peak profile. Moreover, and as described in greater detail below, the frame members and seals, though described and referenced in the drawings according to some embodiments as substantially U-shaped can take a variety of shapes and forms as appropriate.

FIG. 18 shows another heating unit 1010 including an outer housing 1012, a gas source 1016, and a burner assembly 1018. As shown, the heating unit 1010 is configured as a table, or stand. In other embodiments, the heating unit 1010 is configured as a fireplace or gas campfire, for example. If desired, flame accessories 1019 such as glass pieces, rocks, synthetic embers, or others are supported on the burner assembly 1018 as shown in FIG. 18. Though some configurations and components are shown and described in association with the heating unit 1010, various features of the heating unit 1010 are interchangeable as desired with features of the various embodiments described herein.

The outer housing 1012 is formed of any of a variety of suitable materials, including formed sheet metals or anodized aluminum, for example. The outer housing 1012 includes a plurality of legs 1020 and a support frame 1022 having an open interior 1022A through which the burner assembly 1018 is viewable, where one of the plurality of legs 1020 secured at each corner of the support frame 1022 to support the heating unit 1010. Although the support frame 1022 is shown as substantially rectangular in shape, the support frame 1022 optionally takes on a variety of shapes, including circular or oval, for example.

In some embodiments, one side or corner of the outer housing 1012 is raised or elevated relative to a remainder of the housing 1012. For example, a first leg 1020 A is substantially longer (e.g., from about 0.25 inches to about 1 inch) than the remaining legs 1020. In outer door applications, the raised corner 1022B helps move water toward a burner conduit at the opposite corner of the housing 1012 where the water is collected in a water trap or is allowed to drain out of the appliance 1010. Alternatively or additionally, a cover (not shown) is optionally employed to reduce water ingress as desired.

As shown in FIG. 18, the gas source 1016 is a portable LP tank with an associated regulator and tubing, such as those used in association with gas grills, for example. In other embodiments, the gas source 1016 includes a regulator connected to an external gas line, such as a natural gas or LP gas line associated with residential, commercial, or other structure. Gases other than natural gas or propane are also contemplated, such as hydrogen, for example.

Figure 19:
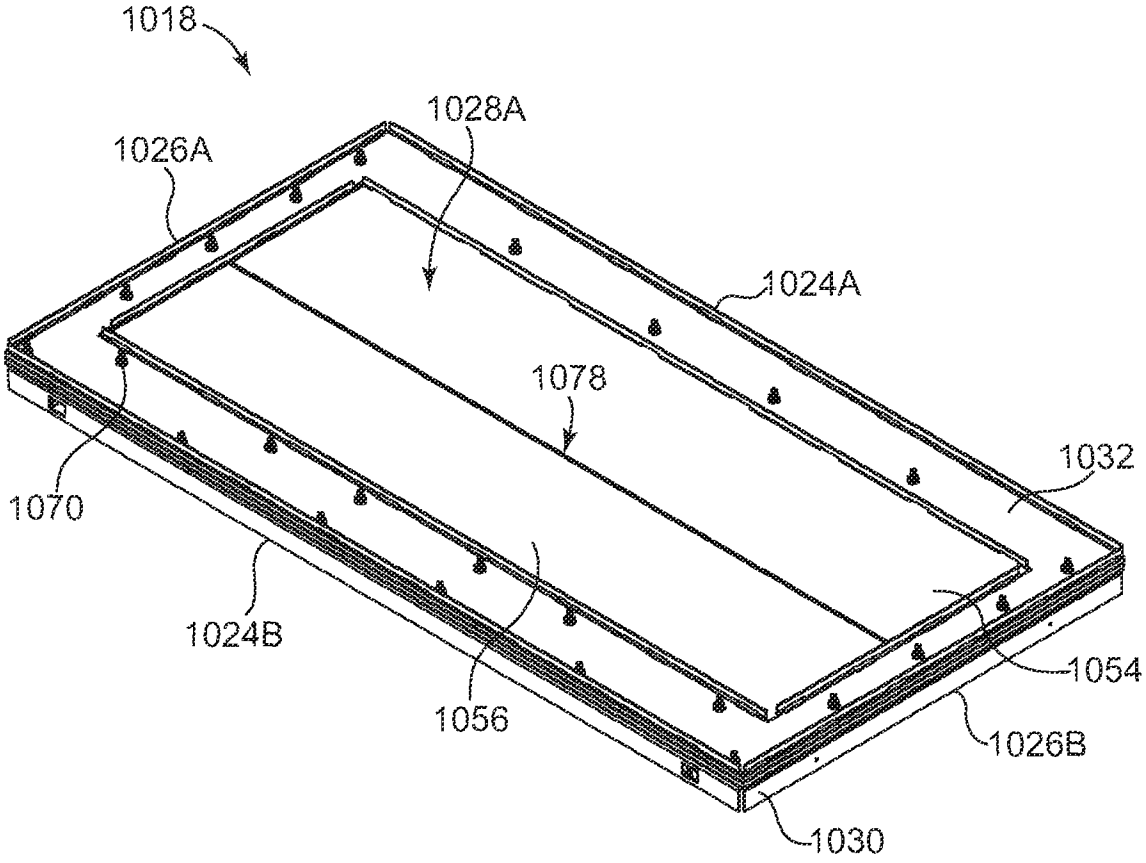
FIG. 19 is a perspective view of a burner assembly of the heating unit of FIG. 18, according to some embodiments.

FIG. 19 is a perspective view of the burner assembly 1018, according to some embodiments. As shown in FIG. 19, the burner assembly 1018 defines a width between a first side 1024A and a second side 1024B that is opposite the first side 1024A; a length between a first end 1026A and a second end 1026B that is opposite the first end 1026A; and a thickness between a first face 1028A and a second face 1028B (FIG. 22) that is opposite the first face 1028A.

As shown in FIG. 19, the first face 1028A corresponds to a top of the burner assembly 1018 (a portion that normally faces up), although in other embodiments the first face 1028A corresponds to a front, back, or side of the burner assembly 1018 or even a bottom of the burner assembly 1018, for example. In some embodiments, the burner assembly 1018 is about 37 inches long, about 19 inches wide, and about 2 inches thick, although a variety of dimensions are contemplated. Although the burner assembly 1018 is shown in a rectangular configuration, any of a variety of other shapes are also contemplated, including circular, octagonal, irregular, or other shapes.

Figure 20:
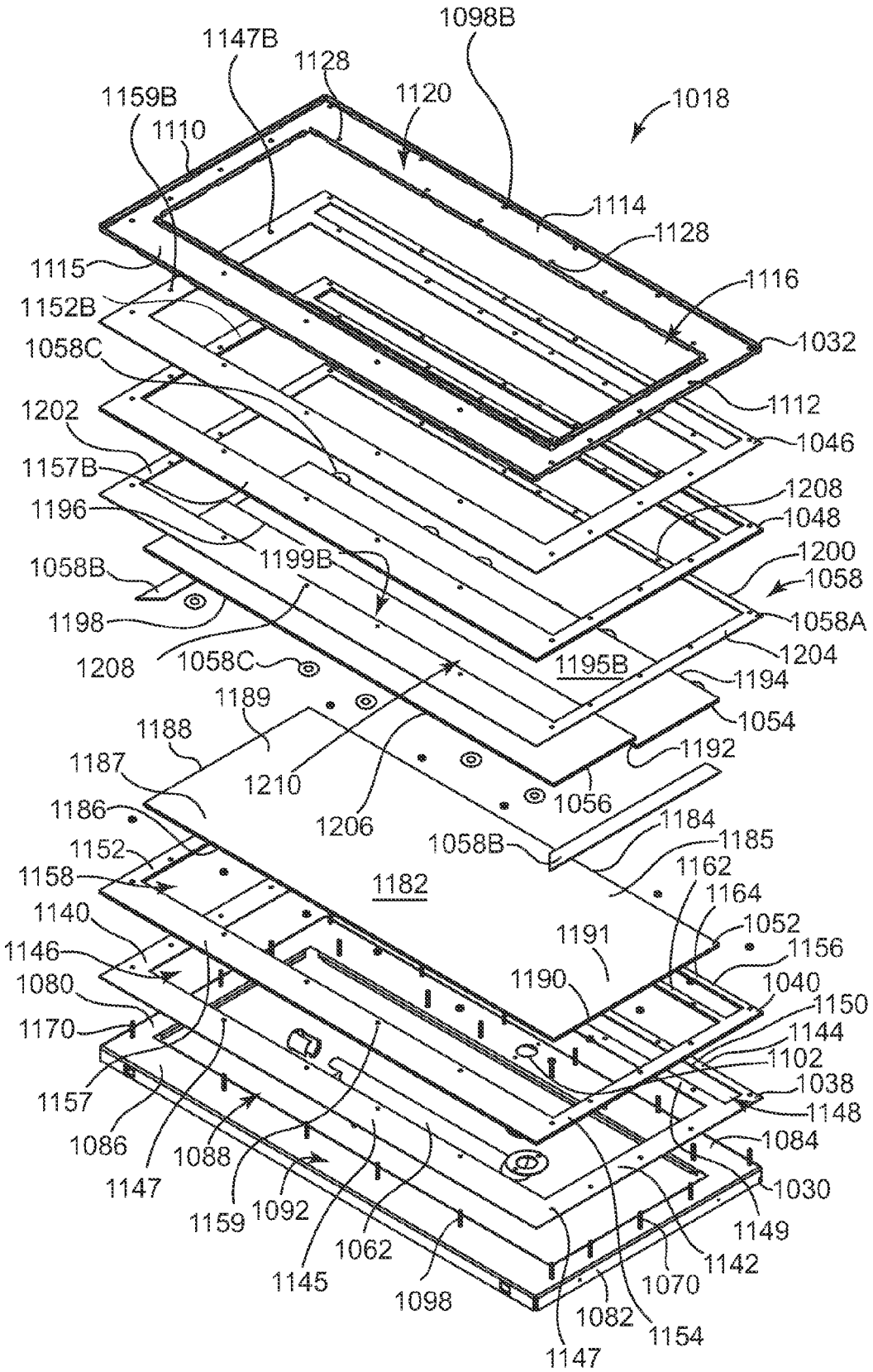
FIG. 20 is a first perspective view of the burner assembly of FIG. 19 in an unassembled state, according to some embodiments.
Figure 21:
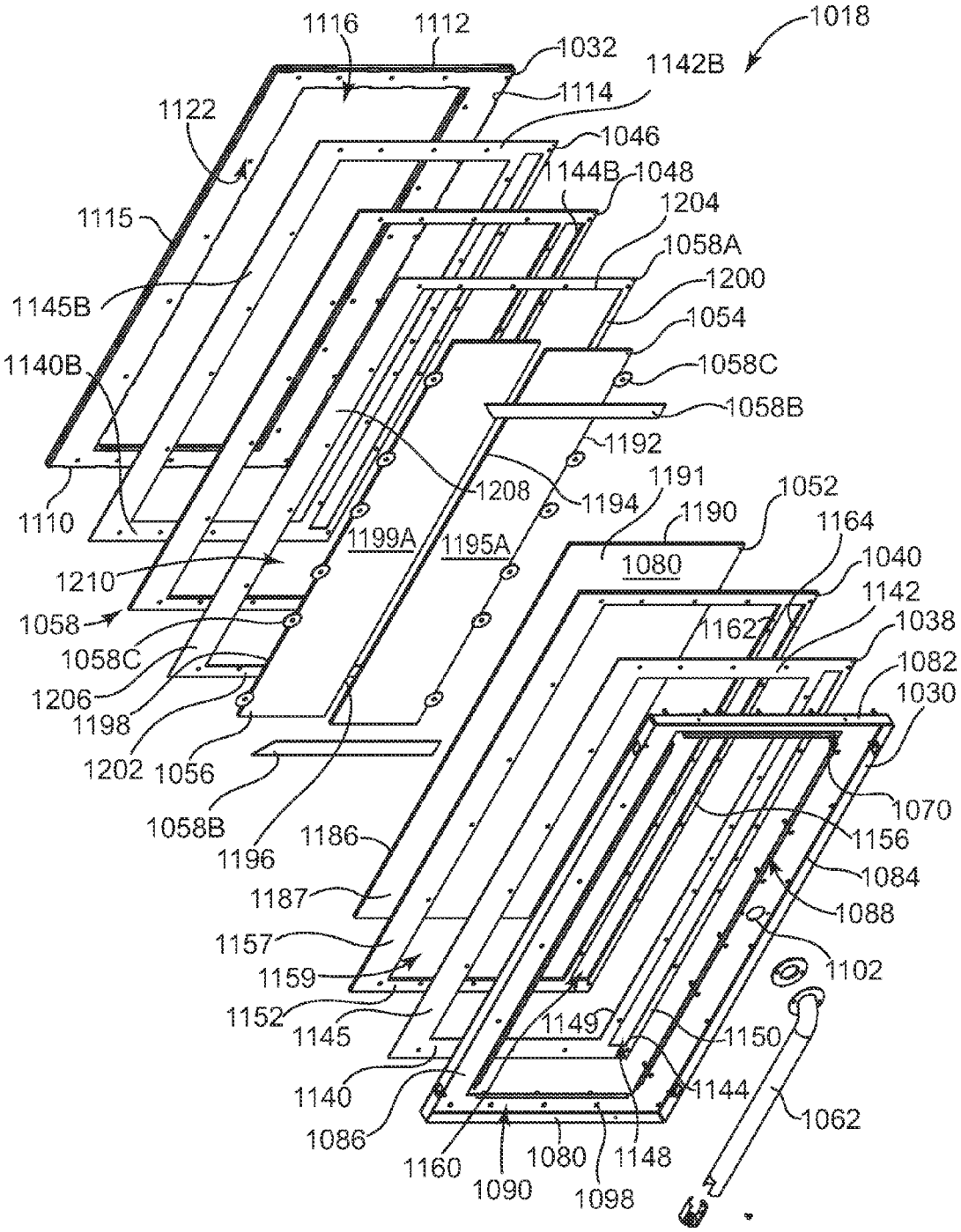
FIG. 21 is a second perspective view of the burner assembly of FIG. 19 in an unassembled state, according to some embodiments.

FIGS. 20 and 21 are perspective views of components of the burner assembly 1018 in an unassembled state. In some embodiments, FIG. 20 corresponds to a downward-looking perspective view while FIG. 21 corresponds to an upward-looking perspective view. As shown, the burner assembly 1018 includes a first frame member 1030, a second frame member 1032, a first intermediate seal 1038, a first spacer 1040, a second intermediate seal 1046, a second spacer 1048, a first plate 1052, a second plate 1054, a third plate 1056, an inner seal 1058, a connector 1062, and a plurality of fasteners 1070, the fasteners optionally being similar to the fasteners 70 previously described. In some embodiments, the burner assembly 1018 includes an igniter (not shown) such as those previously described. In other embodiments, a user (not shown) of the heating unit 1010 uses a hand held igniter to light the heating unit 1010.

As described in greater detail, below the spacers 1040, 1048 and frame members 1030, 1032 provide means for supporting the plates 1052, 1054, 1056 in an opposed relationship while the seals 1038, 1046, 1058 provide means for sealing the space between the plates 1052, 1054, 1056 (e.g., by forming a perimeter seal about the plates 1052, 1054, 1056) to form inlet/outlet chambers of the burner assembly 1018.

In some embodiments, various components of the burner assembly 1018 are sandwiched together to form a substantially thin, or slim burner structure (e.g., about 1 to 3 inches thick overall) with the fasteners 1070 securing the structure together. Generally, the first and second frame members 1030, 1032 (as well as the seals 1038, 1046 and spacers 1040, 1048) form a housing around the first, second, and third plates 1052, 1054, 1056. As described in greater detail, the burner assembly 1018 forms an outlet chamber 1072 (FIG. 23) that is relatively thin (e.g., about 0.5 inches, 0.25 inches, 0.125 inches, 0.06 inches, or 0.01 inches) and an inlet chamber 1074 (FIG. 23) in communication with the outlet chamber 1072 that is also relatively thin, where the chambers 1072, 1074 are also optionally described as manifolds or plenums, for example. The inlet chamber 1074 helps provide an inlet 1076 (FIG. 23) into the outlet chamber 1072 and the outlet chamber 1072 provides an outlet 1078 (FIG. 23) from the burner assembly 1018. As with various embodiments previously described, the thin chamber design can be advantageous from a gas distribution perspective; facilitate compact, or thin line designs; and/or be used to produce visually unique optical effects.

As shown, the first frame member 1030 includes a first end member 1080, also described as a side portion or upright, a second end member 1082, a first lateral member 1084, also described as a side portion, extending between the first and second end members 1080, 1082, and a second lateral member 1086 extending between the first and second end members 1080, 1082, where the first end member 1080, the second end member 1082, the first lateral member 1084, and the second lateral member 1086 define a central viewing area 1088. The first frame member 1030 also defines an outer face 1090 (FIG. 21), an inner face 1092, and has a plurality of fastener holes 1098.

In some embodiments, the first frame member 1030 includes a set of feet 1100 for securing the burner assembly 1018 to other components such as the outer housing 1012.

In some embodiments, the inner face 1092 of the first frame member 1030 is optionally substantially planar overall. In some embodiments, the first end member 1080 includes features (e.g., one or more tabs) adapted to maintain an igniter (not shown). The first lateral member 1084 is optionally positioned on the first side 1024A (FIG. 19) of the burner assembly 1018 and the second lateral member 1086 is optionally positioned on the second side 1024B of the burner assembly 1018. In some embodiments, the first lateral member 1084 has an opening 1102 for forming a gas inlet plenum, for example, as is subsequently described. The opening 1102 is about 1.25 inches in diameter, for example, although other dimensions are contemplated.

Though a variety of materials and forming processes are contemplated, the first end member 1080, the second end member 1082, and the first and second lateral members 1084, 1086 are optionally formed from a single piece of sheet metal or other material using bending and/or stamping processes, for example. The first end member 1080, the second end member 1082, and the first and second lateral members 1084, 1086 combine to form a substantially square frame, where the central viewing area 1088 is defined on four sides by the first and second end members 1080, 1082, and the first and second lateral members 1084, 1086.

As shown, the second frame member 1032 is substantially complementary in configuration to the first frame member 1030 and includes a first end member 1110, also described as a side portion or upright, a second end member 1112, a first lateral member 1114, also described as a side portion, extending between the first and second end members 1110, 1112, and a second lateral member 1115 extending between the first and second end members 1110, 1112, where the first and second end members 1110, 1112 and the first and second lateral members 1114, 1115 define a central viewing area 1116.

The second frame member 1032 also defines an outer face 1120 and an inner face 1122 (FIG. 21) and has a plurality of fastener holes 1128. The inner face 1122 of the second frame member 1032 is optionally substantially planar overall. In some embodiments, similar forming processes and materials to those of the first frame member 1030 are used to form the second frame member 1032. The first end member 1110, the second end member 1112, the first lateral member 1114, and the second lateral member 1115 combine to form a substantially rectangular frame, where the central viewing area 1116 is defined on four sides by the first end member 1110, the second end member 1112, and the lateral members 1114, 1115.

The various seals/spacers are described below and referenced in the drawings as pre-formed pieces (e.g., being molded, stamped, or cut out) of material, such as silicone. In some embodiments, however, one or more of the seals/spacers are deposited or applied as liquids or gels that cure or are otherwise formed.

The first intermediate seal 1038 is optionally formed as a single piece of gasket material (e.g., high-temp silicone gasket material), or any other suitable material. In some embodiments, the first intermediate seal 1038 is about 0.125 inches thick, although a variety of dimensions (e.g., from about 0.1 inches to about 0.8 inches thick) are contemplated. The first intermediate seal 1038 includes a first arm 1140, or first end portion, a second arm 1142, or second end portion, a first edge portion 1144, and a second edge portion 1145 each connecting the first and second arms 1140, 1142. The first intermediate seal 1038 is substantially rectangular, for example, defining an open interior 1146 bounded by the first arm 1140, the second arm 1142, and the edge portions 1144, 1145 and has a plurality of fastener holes 1147 disposed about the first intermediate seal 1038.

The first edge portion 1144 has an opening 1148 which, as described in greater detail below, helps provide means for forming a gas inlet plenum. As shown, the opening 1148 is substantially rectangular in shape and from about 33 to about 35 inches long and from about 1 to about 3 inches wide (e.g., about 2 inches wide), although a variety of shapes and dimensions are contemplated. The first edge portion 1144 has a first piece 1149 on one side of the opening 1148 toward the open interior and a second piece 1150 on an opposite side of the opening 1148 toward the outer perimeter of the first intermediate seal 1038. The open interior 1146 is sized to be substantially smaller than the first plate 1052 such that the first arm 1140, the second arm 1142, the first piece 1149 and the second edge portion 1145 are sized to overlap the first plate 1052 as received in the first spacer 1040 and as described in greater detail below.

The second intermediate seal 1046 is substantially similar to the first intermediate seal 1038, according to some embodiments. As such, where features of the second intermediate seal 1046 are described and referenced in the drawings they are designated by a similar reference number to the first intermediate seal 1038 followed by a "B."

In some embodiments, the first spacer 1040 is formed as a single piece of material. In some embodiments, the first spacer 1040 is adapted to support the first plate 1052 and/or to provide anchor points for fastening the various burner components together without unduly stressing the first plate 1052. For example, the first spacer 1040 is formed of steel or another sufficiently rigid material (e.g., polymeric or metallic materials) for receiving and supporting the first plate 1052 and/or providing suitable assembly anchor points. In some embodiments, the first spacer 1040 is about 0.25 inches thick, although a variety of dimensions are contemplated (e.g., from about 0.1 to about 0.5 inches thick). In some embodiments, the first spacer 1040 has about the same thickness as the first plate 1052.

The first spacer 1040 includes a first arm 1152, also described as a side portion, a second arm 1154, a first leg 1156, also described as a side portion, connecting the first and second arms 1152, 1154, and a second leg 1157 connecting the first and second arms 1152, 1154. In some embodiments, the first spacer 1040 is substantially rectangular, defining an open interior 1158 bounded by the first arm 1152, the second arm 1154, and the first and second legs 1156, 1157. The open interior 1158 is sized to be substantially complementary in size to the first plate 1052, such that the first plate 1052 is able to be received in the open interior 1158 in a substantially complementary fit. The first spacer 1040 also includes a plurality of fastener holes 1159 disposed about the first spacer 1040.

The first edge portion 1156 has an opening 1160 (FIG. 21) which, as subsequently described, helps provide means for forming a lower chamber, or plenum of the burner assembly 1018. As shown, the opening 1160 is substantially rectangular in shape and from about 33 to about 35 inches long and about 2 inches wide, although a variety of shapes and dimensions are contemplated (e.g., from about 1 inch to about 3 inches in width). As shown, the first edge portion 1156 defines a first piece 1162 toward the open interior 1158 and a second piece 1164 opposite the first piece 1162.

The second spacer 1048 is substantially similar to the first spacer 1040, according to some embodiments. As such, where features of the second spacer 1048 are described and referenced in the drawings they are designated by a similar reference number to the first spacer 1040 followed by a "B."

In some embodiments, the first plate 1052 is substantially rectangular in shape, having a length of from about 33 to about 35 inches, a width of about 14 inches, and a thickness of about 0.25 inches, although a variety of dimensions are contemplated (e.g., a plate thickness from 0.1 to about 0.5 inches). The first plate 1052 is optionally formed of ceramic glass, or other suitable material.

In some embodiments, the first plate 1052 is formed of a substantially transparent, or see-through material (e.g., ceramic glass) such that light is able to pass through the first plate 1052. Additionally, or alternatively, the first plate 1052 is formed of substantially reflective material (e.g., a material such as Mirropane™ available from Toledo-Pilkington North America Inc. of Toledo, Ohio) or other materials. In still other embodiments, the first plate 1052 is formed of opaque materials, such as marble, sheet metal, or others.

The first plate 1052 defines an outer face 1180 (FIG. 21), an inner face 1182, a first side edge 1184 along a first side portion 1185 of the first plate 1052, a second side edge 1186 along a second side portion 1187 of the first plate 1052, a first end edge 1188 along a first end portion 1189 of the first plate 1052, and a second end edge 1190 along a second end portion 1191 of the first plate 1052.

In some embodiments, the inner and/or outer faces 1180, 1182 of the first plate 1052 are substantially planar, where the inner and/or outer faces 1180, 1182 are optionally smooth (e.g., as with typical sheet glass) or include surface features (e.g., bumps, ridges, dimpling, facets, or other features) while being considered substantially planar. In some other embodiments, the inner and/or outer faces 1180, 1182 are not substantially planar (e.g., including larger-scale waves or bends). For example, the first, second, and third plates 1052, 1054, 1056 are optionally substantially S-shaped and fit together, at a spaced relationship, in a complementary manner.

The second and third plates 1054, 1056 are each generally similar to the first plate 1052, according to some embodiments, though, as shown, of different dimensions than the first plate 1052. For example, in some embodiments, the second and third plates 1054, 1056 are each substantially the same length and thickness as the first plate 1052 and one or both of the second and third plates 1054, 1056 is less than half the width of the first plate 1052. In some embodiments, the second plate 1054 defines an inner edge 1192, also described as a terminal edge, and an outer edge 1194, also described as a perimeter edge, as well as an inner face 1195A (FIG. 21) and an outer face 1195B. In turn, in some embodiments, the third plate 1056 defines an inner edge 1196, also described as a terminal edge, and an outer edge 1198, also described as a perimeter edge as well as an inner face 1199A and an outer face 1199B. As described in greater detail below, once the burner assembly 1018 is assembled, the second and third plates 1054, 1056 are positioned in a common plane with a space between the inner edges 1192, 1196 forming the outlet 1078 (FIG. 23) from the burner assembly 1018.

As shown, the inner seal 1058 optionally includes a primary gasket 1058A, a plurality of edge spacers 1058B, and a plurality of washers 1058C. Note that the inner seal 1058 is shown above the second and third plates 1054, 1056 in FIGS. 20 and 21, although upon assembly the inner seal 1058 resides between the first plate 1052 and the second and third plates 1054, 1056 as subsequently described. In some embodiments, the primary gasket 1058A is made of a compressible gasket material, such as a high temperature foamed silicone. In turn, the edge spacers 1058B and the washers 1058C are optionally made of higher durometer material, such as a high temp silicone, to help better serve a spacing function between the first and second plates 1052, 1054 and first and third plates 1052, 1056. As described in greater detail below, the inner seal 1058 helps seal the first plate 1052 and the second and third plates 1054, 1056, as well as the first and second spacers 1040, 1048, as well as maintain spacing between the first plate 1052 and the second and third plates 1054, 1056.

In some embodiments, the primary gasket 1058A is about 0.06 inches thick, although a variety of dimensions are contemplated (e.g., from about 0.01 inches to about 0.25 inches thick). The primary gasket 1058A includes a first leg 1200, or first edge portion, a first arm 1202, or first end portion, a second arm 1204, or second end portion, and a second leg 1206, or second edge portion, where the first leg 1200 and the second leg 1206 extend between the first and second arms 1202, 1204. The primary gasket 1058A also includes a plurality of fastener holes 1208 disposed about the primary gasket 1058A.

The primary gasket 1058A is substantially rectangular, defining an open interior 1210 bounded by the first leg 1200, the first arm 1202, the second arm 1204, and the second leg 1206. In some embodiments, the open interior 1210 is sized to be shorter than the first plate 1052 and shorter than the spaced, second and third plates 1054, 1056, such that the first and second arms 1202, 1204 are sized to abut the first plates 52, 54 upon assembly of the burner assembly 18. In turn, the open interior 202 is wider than the first plate 1052, as well as the wider than the spaced-pair of second and third plates 1054, 1056, in order to leave a space next to the first side edge 1184 of the first plate 1052 and the outer edge 1194 of the second plate 1054. In particular, in some embodiments, the first and second arms 1202, 1204 are adapted to overlap to some extent the first plate 1052, the second plate 1054, and the third plate 1056, while the first leg 1200 resides below the first and second plates 1052, 54 at an offset from the first side edge 1184 and the outer edge 1194 of the first and second plates 52, 54, respectively. In some embodiments, the first leg 1200 is about 0.6 inches wide, although other dimensions are contemplated.

The edge spacers 1058B are adapted to be positioned between the first plate 1052 and the second plate 1054 and the first plate 1052 and the third plate 1056 next to the inner faces 1182, 1195A, 1199A of the plates along the first end edge 1188 and the second end edge 1190 of the first plate 1052. In turn, the washers 1058C are positioned at locations corresponding to the various fastener holes so that they partially project between the first plate 1052 and the second plate 1054 at the first side edge 1184 and the outer edge 1194 and between the first plate 1052 and the third plate 1056 at the second side edge 1186 and the outer edge 1198.

As subsequently described, the washers 1058C are held in position with the fasteners 1070 and help ensure that the relatively softer primary gasket 1058A is not compressed more than desired upon tightening the fasteners 1070. The edge spacers 1058B optionally serve a substantially similar function, being of a substantially similar thickness and/or material as the washers 1058C.

As shown, in some embodiments the connector 1062, also described as a conduit, is substantially similar to the connector 62. Additionally, the fasteners 1070 are optionally substantially similar to the fasteners 70.

Figure 22:
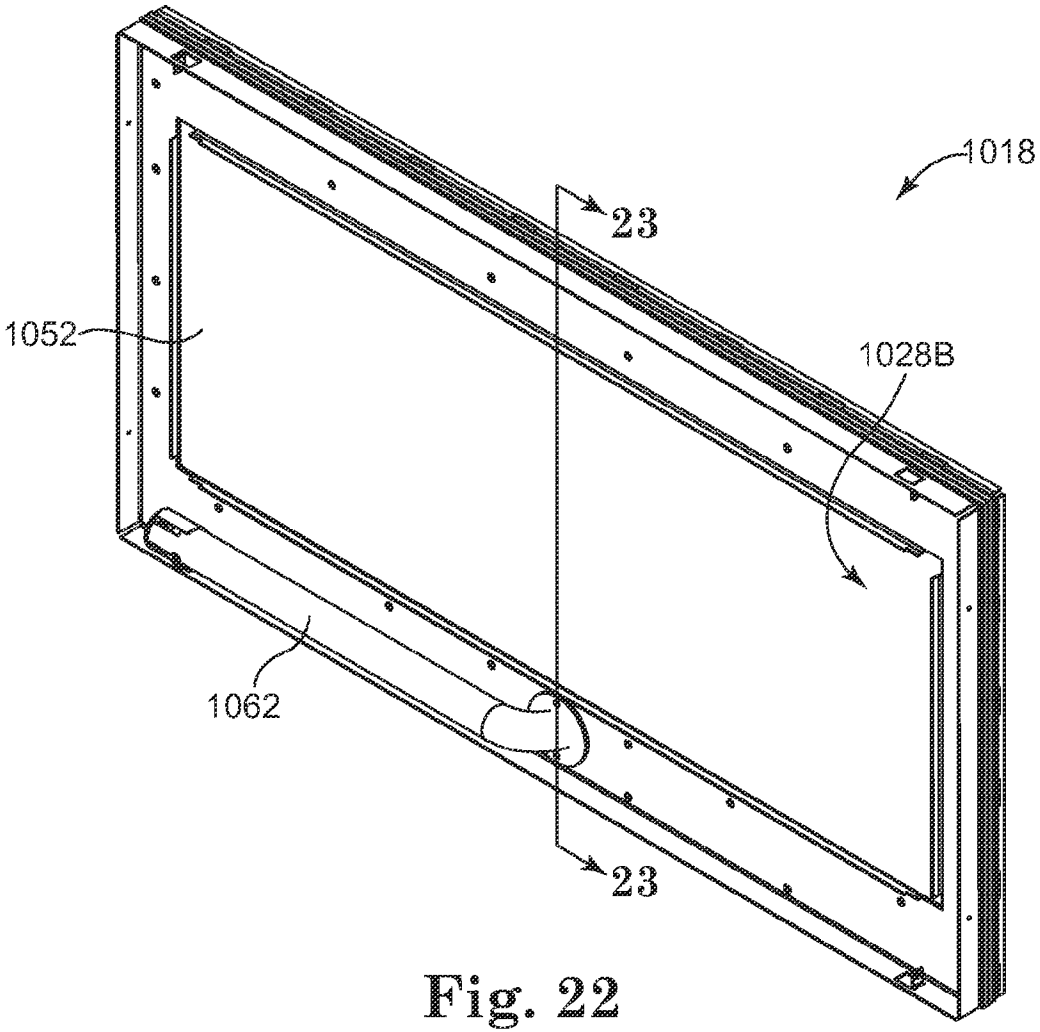
FIG. 22 is another perspective view of the burner assembly of FIG. 19, according to some embodiments.
Figure 23:
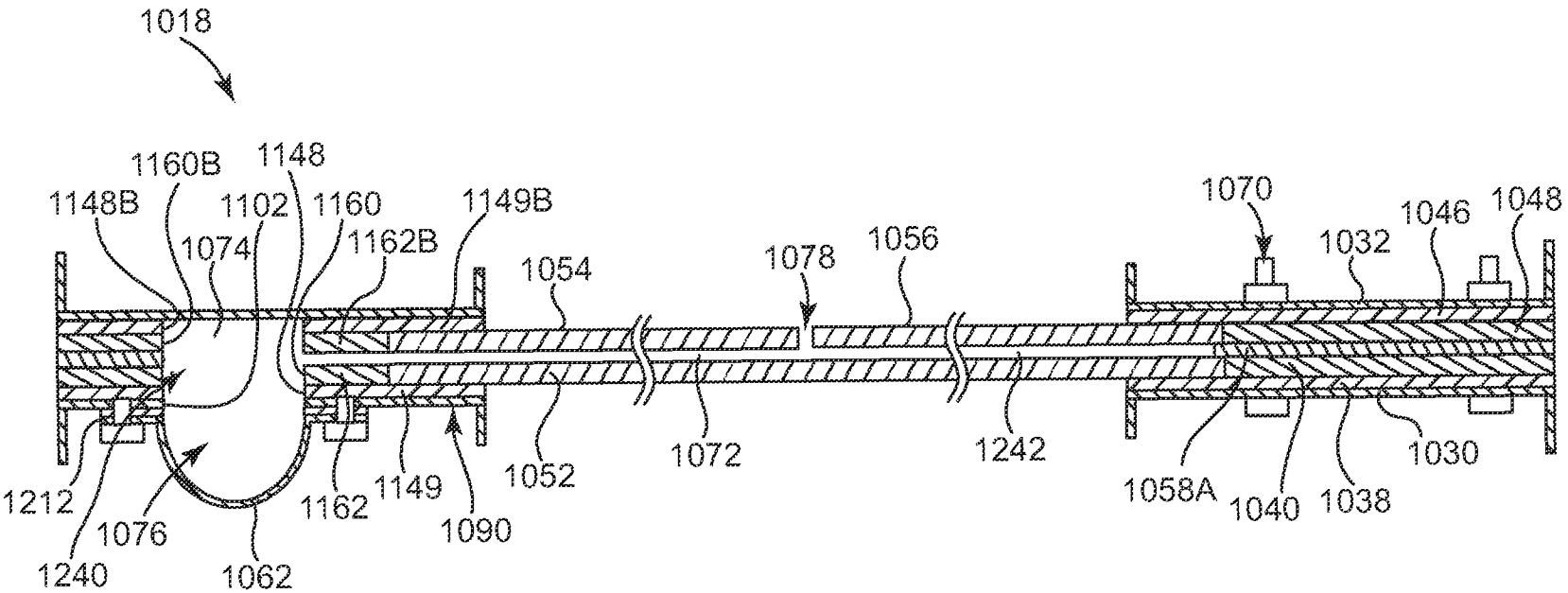
FIG. 23 is a cross-sectional view along line 23-23 of FIG. 22, according to some embodiments.

FIG. 19 is a perspective view of the burner assembly 1018 in an assembled state from a top-down perspective and FIG. 22 is a perspective view of the burner assembly 1018 from a bottom-up perspective, according to some embodiments. FIG. 23 is a cross-sectional view of a portion of the burner assembly 1018 without the connector 1062 along line 23-23 shown in FIG. 22, according to some embodiments. Reference can be made between the unassembled, exploded views of FIGS. 20 and 21 and the assembled views of FIGS. 19 and 22-24 as appropriate to assist in understanding some methods of assembling the burner assembly 1018.

In some embodiments, assembly includes disposing the first spacer 1040 about the first plate 1052, with the first plate 1052 received in the open interior 1158 of the first plate 1052. The first spacer 1040 is optionally about the same thickness as the first plate 1052. In turn, the second and third plates 1054, 1056 are received in an open interior 1158B of the second spacer 1048, the second spacer 1048 optionally being about the same thickness as each of the second and third plates 1054, 1056.

In some embodiments, the first and second spacers 1040, 1048 are aligned to one another and are disposed opposite one another with the first plate 1052 disposed opposite the second and third plates 1054, 1056 in a substantially parallel, spaced relationship. As shown, the inner edges 1192, 1196 of the second and third plates 1054, 1056 are spaced from one another to define the outlet 1078 from the burner assembly 18 and the outer edges 1194, 1198 are substantially aligned with the first plate 1052.

The edge spacers 1058B are positioned between the first plate 1052 and the second plate 1054 and between the first plate 1052 and the third plate 1056 along the first and second end edges 1188, 1190 of the first plate 1052. In turn, the washers 1058C are distributed about the perimeter of the first plate 1052, extending partially between the first and second spacers 1040, 1048 and partially between the first plate 1052 and the second plate 1054 along the first side edge 1184 as well as partially between the first and third plates 1052, 1056 along the second side edge 1186.

In some embodiments, the primary gasket 1058A is received between the first and second spacers 1040, 1048 to help seal the spacers 1040, 1048 together and the plates 1052, 1054, 1056 together. The primary gasket 1058A seals against the lower pieces 1156, 1156B of the first and second spacers 1040, 1048 leaving an opening 1240 (FIG. 23) that corresponds to the openings 1160, 1160B of the first and second spacers 1040, 1048 and helps define the inlet chamber 1074.

In some embodiments, the primary gasket 1058A is substantially compliant, helping reduce effects of irregularities, misalignment, and/or stress concentrations on the plates 1052, 1054, 1056 and spacers 1040, 1048. Where the plates 1052, 1054, 1056 are formed of glass or other ceramic material, such compliance is useful to prevent cracking of the plates 1052, 1054, 1056. Additionally or alternatively, the relatively harder first and second spacers 1040, 1048 as well as the edge spacers 1058B and washers 1058C optionally assist in this regard (e.g., by helping ensure regular spacing between the plates and/or other components of the burner assembly 18).

In some embodiments, the primary gasket 1058A additionally extends between the inner faces 1182, 1195A of the first and second plates 1052, 1054 and between the inner faces 1182, 1199A of the first and third plates 1052, 1056 along the first end edge 1188, the second end edge 1190, and the second side edge 1186 of the first plate 1052.

In some embodiments, the first and second edge portions 1144, 1145 and the first and second arms 1140, 1142 of the first intermediate seal 1038 are aligned with the first and second arms 1152, 1154 and the first and second legs 1156, 1157 of the first spacer 1040. In turn, the first and second edge portions 1144B, 1145B and the first and second arms 1140B, 1142B of the second intermediate seal 1046 are aligned with the first and second arms 1152B, 1154B and the first and second legs 1156B, 1157B of the second spacer 1048. In some embodiments, the first intermediate seal 1038 is abutted against the first spacer 1040 and the outer face 1180 of the first plate 1052 and the second intermediate seal 1046 is abutted against the second spacer 1048 and the outer faces 1195B, 1199B of the second and third plates 1054, 1056. In particular, the first intermediate seal 1038 substantially overlaps the first spacer 1040 and also overlaps the first plate 1052 toward its outer perimeter and the second intermediate seal 1046 substantially overlaps the second spacer 1048 and also overlaps the second and third plates 1054, 1056 toward their outer perimeters. For example, according to some embodiments, the open interiors 1146, 1146B are sized slightly smaller than the first plate 1052, as well as the perimeter defined by the first and second plates 1052, 1054 once spaced from one another as desired.

In some methods of assembly, the inner face 1092 of the first frame member 1030 is abutted against the first intermediate seal 1038, and the inner face 1122 of the second frame member 1032 is abutted against the second intermediate seal 1046. In some embodiments, the outer perimeters of the first and second frame members 1030, 1032; the first and second intermediate seals 1038, 1046; the first and second spacers 1040, 1048; the first plate 1052 and the perimeter defined by the first and second plates 1052, 1054; and the inner seal 1058 each are substantially aligned with one another. In particular, the fastener holes 1098, 1128 of the first and second frame members 1030, 1032; the fastener holes 1147, 1147B of the first and second intermediate seals 1038, 1046; the fastener holes 1159, 1159B of the first and second spacers 1040, 1048; and the fastener holes 1208 of the inner seal 1058 are all aligned with one another such that the plurality of fasteners 1070 are inserted through corresponding fastener holes and tightened to secure the burner assembly 1018 together.

The connector 1062 is secured to the opening 1102 of the first frame member 1030. In particular, the flange 1212 (FIG. 23) is secured to the outer face 1090 (FIG. 21) to place the connector 1062 in communication with the lower chamber 1074 and, thus, the upper chamber 1072. An igniter, or ignition device (not shown), is mounted as desired (e.g., at the outlet 1078).

In some embodiments, a substantial perimeter portion of the first plates 1052 and the perimeter defined by the second and third plates 1054, 1056 are sealed together to form the outlet chamber 1072. In particular, the perimeter edges of the plates 1052, 1054, 1056 are sealed such that a substantially thin gas chamber—the outlet chamber 1072—is formed between the first and second plates 1052, 1054 and between the first and third plates 1052, 1056. As shown, the outlet 1078 from the outlet chamber 1072 is defined by the space between the inner edges 1192, 1196 of the second and third plates 1054, 1056.

As shown in FIG. 23, in some embodiments, the openings 1148, 1148B of the first and second intermediate seals 1038, 1046; the openings 1160, 1160B of the first and second spacers 1040, 1048; and the opening 1240 combine to define the lower chamber 1074 and the spacing, or gap 1242, between the first and second plates 1052, 1054 and between the first and third plates 1052, 1056 defines the upper chamber 1072. The thicknesses of the edge spacers 1058B and washers 1058C (FIGS. 20 and 21) and additionally or alternatively the primary gasket 1058A are selected to control the thickness of the gap 1242 as desired. For example, the thicknesses of the edge spacers 1058B and washers 1058C are optionally substantially uniform such that the gap 1242 is substantially uniform, or continuous in thickness. In other embodiments, the plates 1052, 1054, 1056 are varied in thickness, the surfaces of one or more of the inner faces 1182, 1195A, 1199A of the plates 1052, 1054, 1056 are varied, and/or components of the inner seal 1058 (e.g., the edge spacers 1058B and washers 1058C) are varied in thickness to vary the thickness of the gap 1242.

As shown in FIG. 19, in some embodiments, the outlet 1078 is substantially elongate, linear, and extends without interruption (e.g., for a length of about 33.5 inches at a width of about 0.06 inches, although a variety of dimensions are contemplated). In some embodiments, the second and third plates 1054, 1056 are spaced from one another such that the outlet 1078 is less than about 0.5 inches wide, from about 0.03 inches to about 0.125 inches, or from about 0.01 inches to about 0.25 inches, for example, although other dimensions are contemplated. A variety of lengths are also contemplated, including the outlet 1078 extending continuously without interruption for greater than about 1 inch, for greater than about 3 inches, from about 3 inches to about 48 inches, for greater than about 12 inches, or for greater than about 24 inches, for example, although other dimensions are contemplated.

In some embodiments, the upper chamber 1072 is greater than about 1 inch long, is greater than about 3 inches long, is from about 3 inches long to about 48 inches long, is from about 3 inches in width to about 36 inches in width, and the gap 1242 is defined such that the upper chamber 1072 is about 0.03 inches in thickness, or depth, to about 0.125 inches in thickness, or from about 0.01 inches to about 0.25 inches in thickness, for example, although a variety of dimensions are contemplated. In turn, the lower chamber 1074 is from about 1 inch to about 3 inches in width; is from about 0.125 to about 3 inches in thickness, from about 0.25 inches to about 2 inches in thickness, or from about 0.01 to about 0.25 inches in thickness; and is greater than 1 inch in length, is greater than about 3 inches in length, or is from about 3 inches to about 48 inches length, for example, although a variety of dimensions are clearly contemplated.

As shown in FIG. 18, the burner assembly 1018 is optionally assembled into a table-like configuration by securing the outer housing 1012 to the burner assembly 1018 with the second and third plates 1054, 1056 remaining exposed and the first plate 1052 optionally being viewable through the second and third plates 1054, 1056 where the second and third plates 1054, 1056 are configured to transmit light according to some embodiments and/or reflect light according to others. The second and third plates 1054, 1056 are optionally thick enough to support typical loads associated with recreational tables (e.g., drinks, books, etc.) and/or flame accessories 1019 such as glass pieces, rocks, synthetic embers, or others. For example, the support frame 1022 is optionally fastened to the burner assembly 1018 using fastening means such as bolts or screws and the plurality of legs 1020 are attached to the support frame 1022 using similar fastening means or other fastening means such as welding. The connector 1062 (FIG. 22) is placed in communication with the gas source 1016, including any flow regulators, means for varying air-to-gas mixture ratios, or other equipment feeding the burner assembly 1018 through the connector 1062. The heating unit 1010 is then lit by sparking or otherwise starting a flame at the outlet 1078 of the burner assembly 1018 (e.g., using an associated igniter such as those previously described or by using a manual igniter).

In some embodiments, the burner assembly 1018 is positioned in the outer housing 1012 such that substantial portions of the plates 1052, 1054, 1056 are exposed to a viewer though the open, central portion 1022A of the outer housing 1012 with a remainder of the burner assembly 1018 substantially hidden from view by the outer housing 1012. Where the plates 1052, 1054, 1056 are substantially transparent or semi-transparent, a viewer is able to see through the burner assembly 1018. In some designs, the visible impact of the burner assembly 1018 is greatly reduced via such transparency. For example, where the plates 1052, 1054, 1056 are formed of a substantially transparent material, light is able to pass through the central viewing area 1088, through the plates 1052, 1054, 1056 and out through the central viewing area 1088B. In some embodiments, this lends an appearance that a source of the flames 1022 is substantially hidden, the edges of the outlet 1078 having little visual impact. This hidden-source feature is useful in various scenarios, including creating an eye-catching visual effect.

In other embodiments, the plates 1052, 1054, 1056 are substantially reflective to add depth perception and/or an infinity effect where dual reflection is employed.

In some embodiments, the burner assembly 1018 is used in a method of producing flames 1022 to provide a substantially continuous, uninterrupted body of flames 1022 extending across the outlet 1078. In contrast to burners with a multitude of small distinct holes for delivering combustible gases, the burner assembly 1018 optionally provides a single, substantially thin and elongate outlet 1078 or multiple thin and elongate outlets. In at least such manner, the outlet 1078 is optionally selected to provide means for forming a substantially continuous body of flames 1022 across the upper portion of the burner assembly 1018. It should also be understood that in addition to providing a slim, compact design, the spacing, length, and shape of the gap 1242 are altered as appropriate to provide a desired BTU output from the burner assembly 1018. Similarly to the burner assembly 18, an effect whereby the flames 1022 race from one side to the other of the burner assembly 1018 is achieved as desired.

Additional design modifications are contemplated, including orientation of the burner assembly 1018 in a substantially vertical orientation, forming multiple outlets, or forming non-linear outlet profiles. For example, the first plate 1052 is also optionally split into multiple panes to define one or more outlets on an opposite side of the burner assembly 1018 to the outlet 1078.

Figure 24:
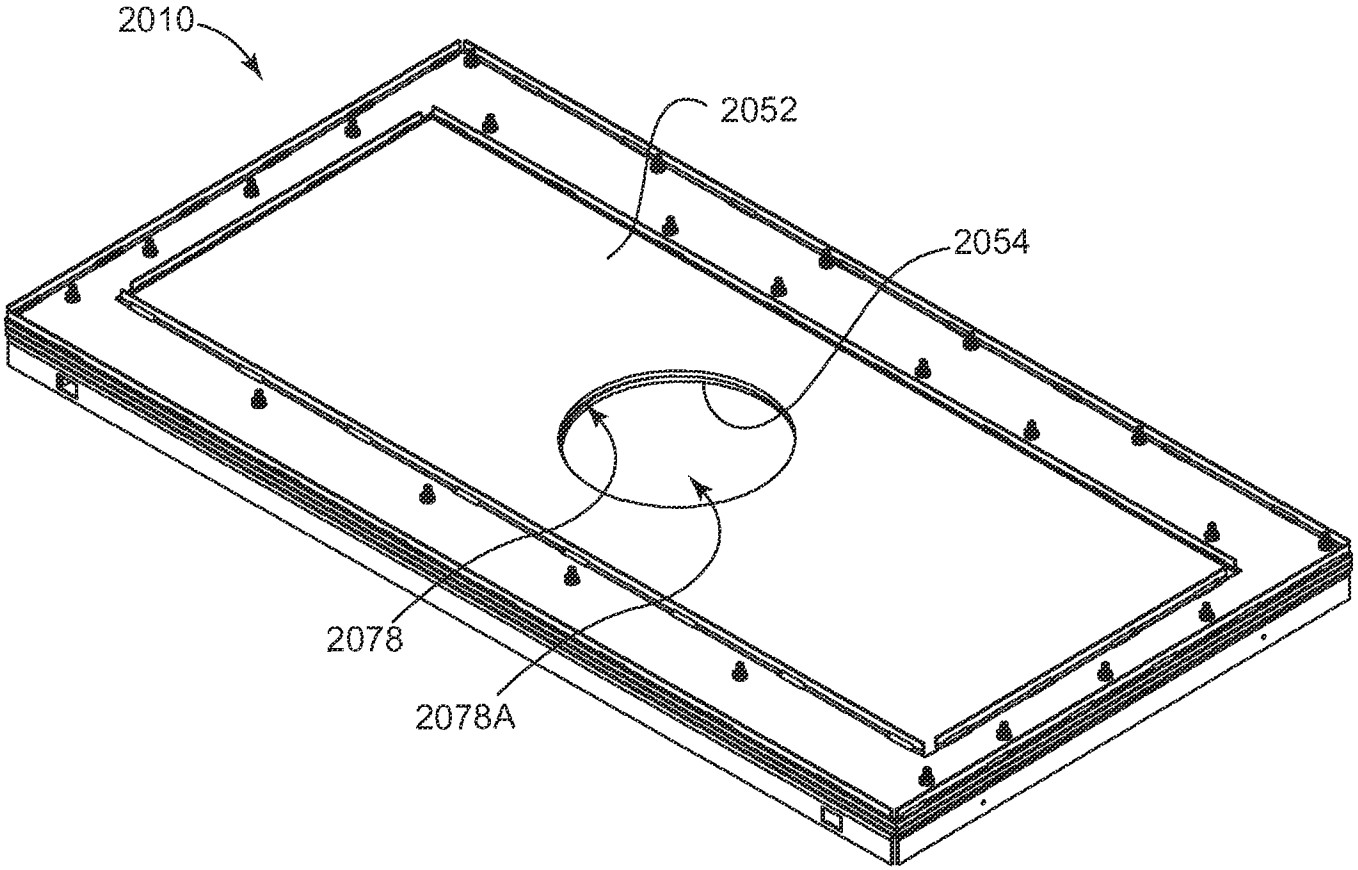
FIG. 24 is a perspective view of a burner assembly, according to some embodiments.

As another example, FIG. 24 shows still another burner assembly 2010. The components of the burner assembly

2010 are optionally substantially similar to the burner assembly 1018 with a modification in the configuration of first and second plates 2052, 2054. In particular, each of the first and second plates 2052, 2054 has a circular opening 2078A defining a thin, continuous and substantially non-linear (e.g., round) outlet 2078, the opening 2078A passing entirely through the burner assembly 2018. Flames (not shown) are generated at the outlet 2078 as desired. In addition to accomplishing a desirable visual effect, in some outdoor applications, rain water or condensation is able to pass through the burner assembly 2018 through the outlet 2078 rather than collecting in the burner assembly 2018. A linear configuration for the outlet 2078 is optionally accomplished by forming a thin, elongate, and substantially rectangular opening in each of first and second plates 2052, 2054 rather than the circular opening shown.

Figure 25:
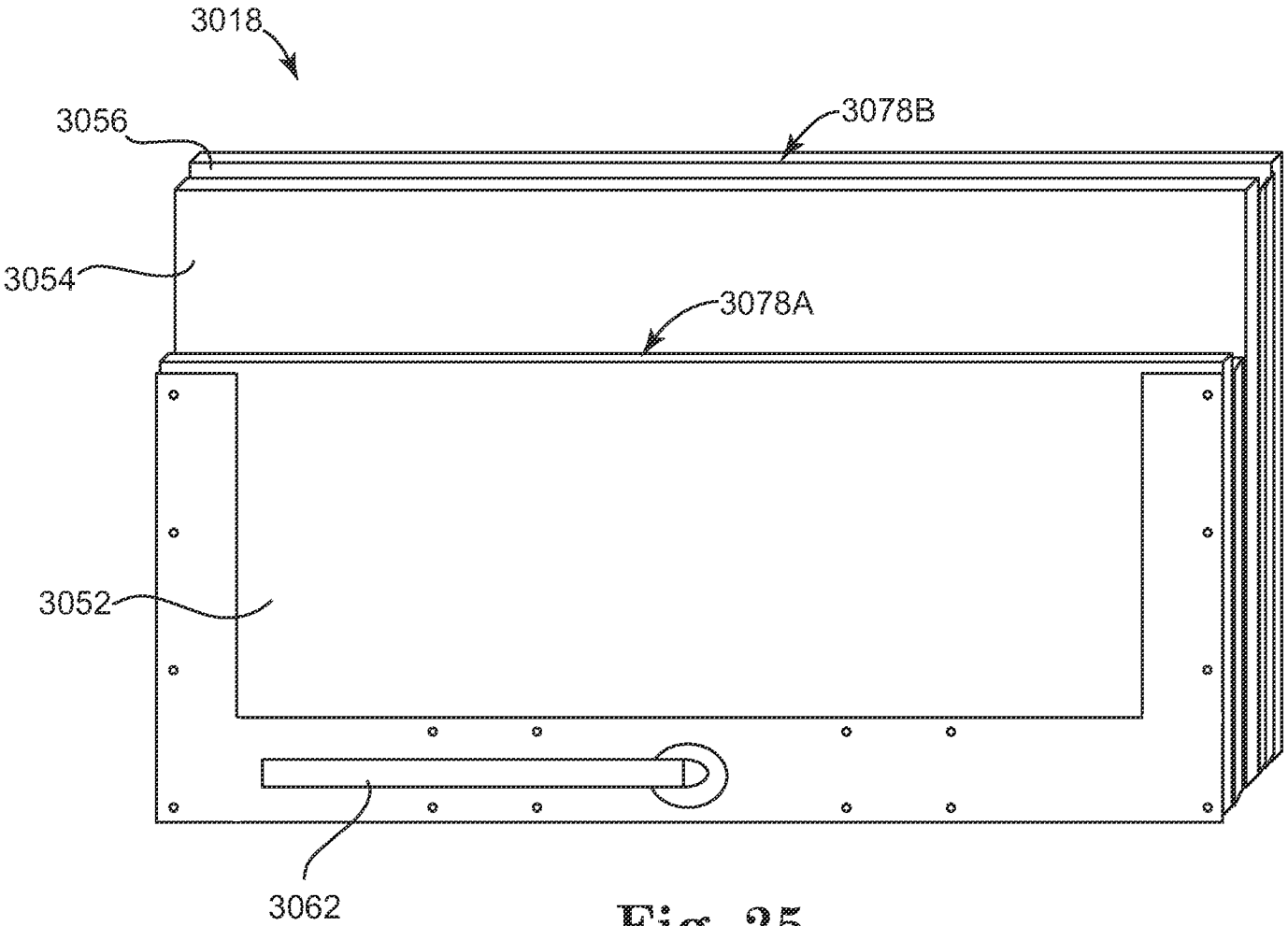
FIG. 25 is a perspective view of a burner assembly, according to some embodiments.

As still another example, FIG. 25 shows yet another burner assembly 3018 having more than two plates, the burner assembly 3018 including first, second and third plates 3052, 3054, 3056 defining a first outlet 3078A between the first and second plates 3052, 3054 and a second outlet 3078B between the second and third plates 3054, 3056. As shown, in some embodiments, the first and second outlets 3078A, 3078B are arranged in a stepped, or staggered fashion to generate sets of flames at different locations. In some embodiments, a single, inlet chamber similar to those previously described feeds into a first outlet chamber between the first and second plates 3052, 3054 and a second outlet chamber between the second and third plates 3054, 3056 such that a single conduit is optionally used to supply gas from the first and second outlets 3078A, 3078B.

Figure 26:
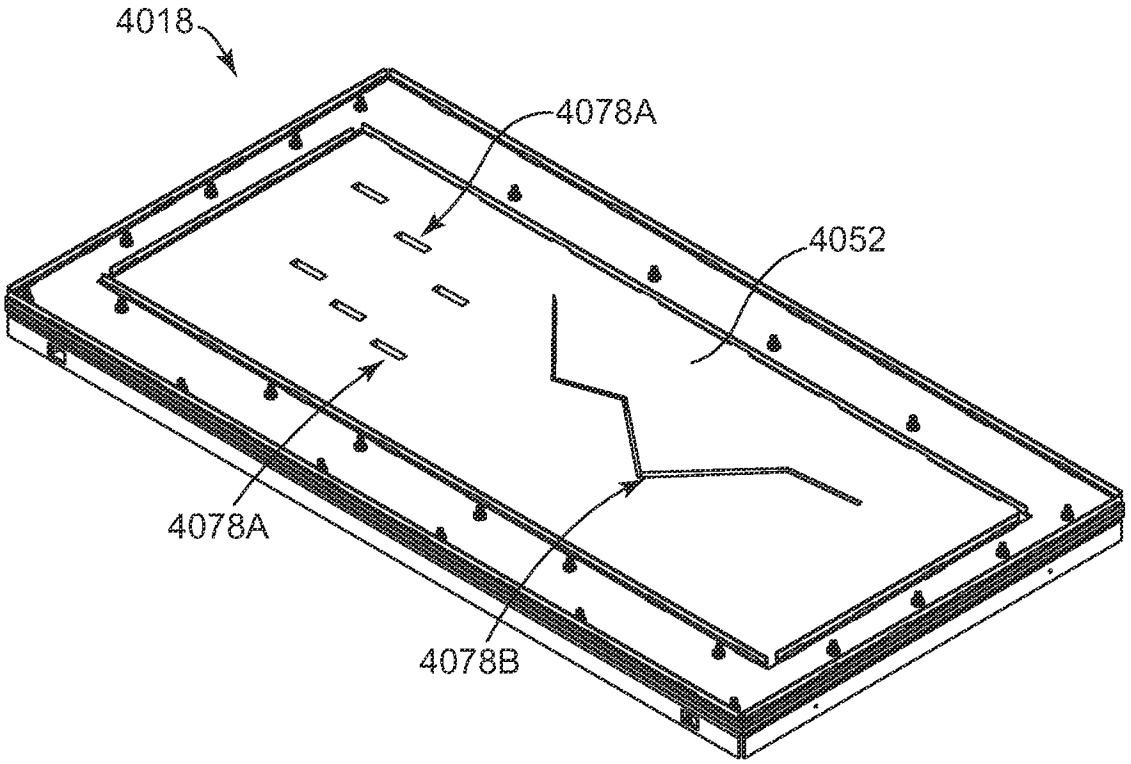
FIG. 26 is a perspective view of a burner assembly, according to some embodiments.

As another example, FIG. 26 shows another burner assembly 4018 defining a plurality of relatively smaller, rectangular openings in a second plate 4054 of the burner assembly 4018 and a jagged, irregular opening in the second plate 4054 defining a first plurality of elongate outlets 4078A and a jagged, angular outlet 4078B from the burner assembly 4018.

Although some examples of flame effects and fireplace installations and configurations have been described, it should be understood a variety of different effects, configurations, and combinations thereof are contemplated without departing from the scope of invention. For example, while the embodiments described above refer to particular features, the scope of invention also includes embodiments having different combinations of features and embodiments that do not include all of the described features. Accordingly, the scope of invention is intended to embrace all such alternatives, modifications, and variations as fall within the claims, together with all equivalents thereof.

What is claimed is:

1. A gas burner assembly comprising:

a first sheet having an inner face and an outer face, the first sheet extending a vertical height between a top edge and a bottom edge and extending a horizontal length between a first side edge and a second side edge opposite the first side edge, the first sheet being formed of an at least partially transparent material to form a central viewing window;

a second sheet having an inner face and an outer face, the second sheet extending a vertical height between a top edge and a bottom edge and extending a horizontal length between a first side edge and a second side edge opposite the first side edge;

the first and second sheets being secured relative to one another such that the first and second sheets are separated by a gap that defines a substantially thin manifold between the inner faces of the first and second sheets, wherein an outlet from the substantially thin manifold is formed along the top edge of the first sheet, and wherein the outer faces of the first and second sheets form externally-facing surfaces of the gas burner assembly, such that the gas burner assembly includes a single substantially thin manifold along a plane perpendicular to the horizontal length of the first sheet and the horizontal length of the second sheet;

a conduit in communication with the substantially thin manifold, the conduit being adapted for connection to a source of gas; and a spacing member located adjacent the first side edge of the first sheet and the first side edge of the second sheet and adjacent the inner faces of the first sheet and the second sheet, wherein the spacing member has a horizontal length that is less than the horizontal length of the first sheet.

2. The gas burner assembly of claim 1, wherein the horizontal length of the spacing member is less than ½ the horizontal length of the first sheet.

3. The gas burner assembly of claim 1, wherein the horizontal length of the spacing member is less than 1/10 the horizontal length of the first sheet.

4. The gas burner assembly of claim 1, wherein the spacing member is a first spacing member, wherein the burner assembly further comprises a second spacing member located adjacent the second side edge of the first sheet and the second side edge of the second sheet and adjacent the inner faces of the first sheet and the second sheet, and wherein the second spacing member has a horizontal length that is less than the horizontal length of the first sheet.

5. The gas burner assembly of claim 4, wherein the first spacing member and the second spacing member are positioned so that a horizontal line intersects the first spacing member and the second spacing member, and wherein the first spacing member and the second spacing member are horizontally separated by a spacer gap.

6. The gas burner assembly of claim 5, wherein the spacer gap has a length that is more than half of the horizontal length of the first sheet.

7. The gas burner of claim 4, further comprising a third spacing member located adjacent the bottom edge of the first sheet and adjacent the inner faces of the first sheet and the second sheet.

8. The gas burner of claim 7, wherein the first spacing member, the second spacing member, and the third spacing member are integrally formed.

9. The gas burner of claim 4, wherein the first spacing member has a vertical height that is greater than half of the vertical height of the first sheet and wherein the second spacing member has a vertical height that is greater than half of the vertical height of the first sheet.

10. The gas burner of claim 1, wherein the spacing member has a vertical height that is equal to the vertical height of the first sheet.

11. The gas burner of claim 1, wherein the spacing member has a vertical height that is greater than half of the vertical height of the first sheet.

12. A gas burner assembly comprising:

a first sheet having an inner face and an outer face, the first sheet extending a vertical height between a bottom edge and a top edge;

a second sheet having an inner face and an outer face, the second sheet extending between a bottom edge and a top edge, the first sheet and the second sheet partially defining an upper manifold having an outlet formed along the top edge of the first sheet, the first sheet being formed of an at least partially transparent material to form a viewing window, the viewing window forming an externally facing surface of the gas burner assembly;

a lateral frame member located proximate to the bottom edge of the first sheet;

a first vertical frame member located proximate to a first end of the second sheet;

a second vertical frame member located proximate to a second end of the second sheet opposite the first edge of the second sheet, wherein outer surfaces of the lateral frame member, first vertical frame member, and second vertical frame member form externally facing surfaces of the gas burner assembly that frame the viewing window;

a sealing element located between the outer face of the first sheet and the inner face of the lateral frame member, the sealing element defining a boundary of a lower manifold located below the upper manifold; and a conduit adapted for connection to a source of gas, the conduit adapted to transmit gas from the source of gas to the lower manifold, such that the gas contacts the inner surface of the first sheet adjacent the bottom edge of the first sheet.

13. The gas burner assembly of claim 12, wherein a width of the lower manifold is greater than a width of the upper manifold.

14. The gas burner assembly of claim 12, wherein the lateral frame member, the first vertical frame member, and the second vertical frame member are aligned in a plane extending vertically and longitudinally, and wherein the plane includes a central portion void of materials, the central portion being horizontally aligned with the viewing window.

15. The gas burner assembly of claim 12, wherein the lateral frame member includes feet at a lower portion of the lateral frame member for maintaining the gas burner assembly in the upright position.

16. The gas burner assembly of claim 12, wherein the conduit is adapted to transmit gas from the source of gas to the upper manifold via the lower manifold.

17. A gas burner assembly comprising:

a first sheet having an inner face and an outer face, the first sheet extending a vertical height between a top edge and a bottom edge and extending a longitudinal length between a first side edge and a second side edge opposite the first side edge, the first sheet being formed of an at least partially transparent material to form a central viewing window;

a second sheet having an inner face and an outer face, the second sheet extending a vertical height between a top edge and a bottom edge and extending a longitudinal length between a first side edge and a second side edge opposite the first side edge;

the first and second sheets being secured relative to one another such that the first and second sheets are separated by a gap that defines a substantially thin manifold between the inner faces of the first and second sheets, wherein an outlet from the substantially thin manifold is formed along the top edge of the first sheet;

a lateral framing member located along a first side edge of the first sheet;

an ignitor support member adapted to support an ignitor proximate to the outlet from the substantially thin manifold, wherein the ignitor support member is secured to a side of the lateral framing member; and a conduit in communication with the substantially thin manifold, the conduit being adapted for connection to a source of gas.

18. The gas burner assembly of claim 17, wherein the ignitor support member comprises means for mounting the ignitor proximate the outlet.

19. The gas burner assembly of claim 18, wherein the means for mounting the ignitor proximate the outlet includes two horizontally extending portions.

20. The gas burner assembly of claim 17, wherein the ignitor support member comprises a vertically extending portion and a horizontally extending portion.

21. The gas burner assembly of claim 20, wherein the lateral framing member lies in a plane extending vertically and longitudinally, wherein the first sheet is on one side of that plane, and wherein the horizontal extending portion of the ignitor support member extends to the other side of that plane.

* * * * *